US011167309B2

(12) United States Patent
Loza et al.

(10) Patent No.: US 11,167,309 B2
(45) Date of Patent: Nov. 9, 2021

(54) DISPENSING ASSEMBLY INCLUDING AN ADDITIVE MIXING DEVICE

(71) Applicant: Silgan Dispensing Systems Corporation, Grandview, MO (US)

(72) Inventors: Daniel Loza, Grandview, MO (US); Jeroen Regt, Grandview, MO (US)

(73) Assignee: Silgan Dispensing Systems Corporation, Grandview, MO (US)

( * ) Notice: Subject to any disclaimer, the term of this patent is extended or adjusted under 35 U.S.C. 154(b) by 0 days.

(21) Appl. No.: 16/699,176

(22) Filed: Nov. 29, 2019

(65) Prior Publication Data

US 2020/0094287 A1 Mar. 26, 2020

Related U.S. Application Data

(63) Continuation-in-part of application No. 16/617,581, filed as application No. PCT/US2019/037737 on Jun. 18, 2019.

(Continued)

(51) Int. Cl.

| | |
|---|---|
| ***B05C 17/005*** | (2006.01) |
| ***B05B 7/04*** | (2006.01) |
| ***B05B 7/24*** | (2006.01) |
| ***B05B 7/32*** | (2006.01) |
| ***B05C 17/00*** | (2006.01) |
| ***B65D 81/32*** | (2006.01) |

(52) U.S. Cl.

CPC ..... *B05C 17/00563* (2013.01); *B05B 7/0408* (2013.01); *B05B 7/2464* (2013.01); *B05B 7/32* (2013.01); *B05C 17/003* (2013.01); *B05C 17/00566* (2013.01); *B65D 81/325* (2013.01); *B65D 2217/02* (2013.01); *B65D 2217/04* (2013.01)

(58) Field of Classification Search

CPC ..... B05C 17/00563; B05C 17/003; B05C 17/00566; B05B 7/0408; B05B 7/2464; B05B 7/32; B05B 11/3085; B05B 7/2462; B05B 11/0078; B65D 81/325; B65D 2217/02; B65D 2217/04

See application file for complete search history.

(56) References Cited

U.S. PATENT DOCUMENTS 3,524,589 A * 8/1970 Pelton, Jr. ..... B05B 7/2421 239/308
4,249,674 A * 2/1981 Antenore ..... B65D 83/685 222/153.11

(Continued)

*Primary Examiner* — Vishal Pancholi
*Assistant Examiner* — Bob Zadeh
(74) *Attorney, Agent, or Firm* — Barlow Josephs & Holmes, Ltd.; Stephen J. Holmes

(57) ABSTRACT

A dispensing system includes a container containing a flowable base formulation to be dispensed, an additive mixing device, and an actuable pump engine which draws the flowable base formulation from the container and pumps it through the mixing device. The additive mixing device includes a body with an internal cavity, an additive ingredient within the cavity, and a flow path/mixing chamber between an input and an output. With each pump of the device the additive ingredient is introduced into, and mixed with, a flow of the base formulation traveling through the mixing device. Multiple additive mixing devices may be interchangeable for different formulations, and the mixing devices may be refillable.

14 Claims, 27 Drawing Sheets

Related U.S. Application Data

(60) Provisional application No. 62/687,828, filed on Jun. 21, 2018, provisional application No. 62/722,560, filed on Aug. 24, 2018, provisional application No. 62/826,637, filed on Mar. 29, 2019.

(56) References Cited

U.S. PATENT DOCUMENTS

| | | | | |
|---|---|---|---|---|
| 4,403,738 | A * | 9/1983 | Kern | B05B 7/2445 239/313 |
| 5,964,377 | A * | 10/1999 | Demarest | B05B 11/3004 222/136 |
| 6,536,687 | B1 * | 3/2003 | Navis | B05B 7/2478 239/345 |
| 6,869,027 | B2 * | 3/2005 | Foster | B05B 11/3009 222/383.1 |
| 7,997,449 | B2 | 8/2011 | Banco et al. | |
| 2008/0314928 | A1 * | 12/2008 | Banco | B05B 11/3084 222/145.5 |
| 2009/0026290 | A1 * | 1/2009 | Fox | B05B 7/2478 239/345 |
| 2010/0059546 | A1 * | 3/2010 | Cimentepe | B05B 11/00416 222/135 |
| 2010/0147700 | A1 * | 6/2010 | Field | A61L 2/22 205/687 |
| 2016/0236219 | A1 * | 8/2016 | Bellante | B05B 11/3014 |
| 2017/0197226 | A1 | 7/2017 | Espinoza | |
| 2020/0094287 | A1 * | 3/2020 | Loza | B05B 7/2464 |

* cited by examiner

DISPENSING ASSEMBLY INCLUDING AN ADDITIVE MIXING DEVICE

CROSS-REFERENCE TO RELATED APPLICATIONS

This application is a continuation-in-part of U.S. application Ser. No. 16/617,581 filed Nov. 27, 2019, which is a § 371 national stage filing of International Application No. PCT/US2019/037737, filed Jun. 18, 2019, which claims the benefit of U.S. Provisional Application No. 62/826,637, filed Mar. 29, 2019, U.S. Provisional Application No. 62/722,560, filed Aug. 24, 2018 and U.S. Provisional Application No. 62/687,828, filed Jun. 21, 2018, the entire contents of each being incorporated by reference herein.

BACKGROUND OF THE DISCLOSURE

Embodiments of the invention relate to dispensing devices for flowable products, and more particularly to a dispensing assembly including an interchangeable and/or refillable additive mixing device which introduces and mixes an additive ingredient into a dispensed flow of a standard base formulation. Each mixing device may contain a different additive ingredient so that the customer may easily change the resulting dispensed product.

Consumers continually drive the need for novel dispensing devices which provide more functionality and better options for a variety of products.

SUMMARY OF THE DISCLOSURE

The present disclosure is directed to a novel additive mixing head which is capable of both introducing and mixing an additive ingredient into a flow of a base formulation with each dispensing cycle. Consider for example, a consumer that needs to carry multiple different SPF sunscreen lotions. Currently, a mother traveling to the beach with her children may need to carry several different full bottles of sunscreen lotion. One SPF lotion for herself and a higher SPF lotion for the children. The sunscreen lotion bottles are large, heavy and expensive, and the situation would be greatly improved if only one bottle were required.

The present disclosure provides a dispensing system including a container containing a flowable base formulation to be dispensed, at least one additive mixing device, and an actuable pump engine which draws the flowable base formulation from the container and pumps it through the mixing device. In the context of a complete system, a plurality of interchangeable additive mixing devices may be provided, each including a different additive ingredient which can be dispensed with the base formulation. For example, different SPF formulations for mixing with a base sunscreen lotion or oil.

The flowable base formulation may include liquids, lotions, oils, gels, etc. Any formulation which is capable of being pumped with an actuable pump engine. The pump engine may include any type of depressible pump or sprayer such as used for lotions, oils or perfume or trigger pumps or sprayers, such as used for liquid cleaning products.

The additive mixing device includes a body with an internal cavity, an additive ingredient disposed within the cavity, or impregnated or mixed within a carrier material disposed within the cavity, and a mixing structure or passage within the cavity between an input and an output of the cavity.

In some embodiments, the additive ingredient is mixed with a carrier material similar to the base formulation, such as a liquid or an oil or a gel, or with a carrier material which is soluble with the base formulation. In some embodiments, the additive ingredient is impregnated into a solid material, which may include crystals, small pills or balls, or larger shapes which fill the cavity and have through holes, apertures, slots or other flow structures, to provide for increased surface area for fluid flow and contact with the additive ingredient. In still other embodiments, the additive ingredient is simply filled into the cavity and metered into the base flow with each dispensing cycle.

The mixing structure may, for example, be an absorbent sponge material which fills the internal cavity of the mixing device. The sponge would hold a quantity of the additive ingredient and its carrier material within its pores, while also providing a complex labyrinth of passageways to force mixing of the additive material with the base formulation as it is forced through the sponge structure. In other embodiments, the solid crystals may fill the cavity or be contained within a replaceable netting material placed within the cavity. The uneven shapes and structures of the crystals creates the necessary turbulent pathways to cause sufficient mixing of the additive ingredient into the flow of the base formulation. Still other embodiments may include a separate mixing passage with interior baffles or other structures adjacent to the cavity output to create a turbulent mixing of the base formulation and additive ingredient as the combined materials pass through the mixing passageway to the output.

With each pump of the device, the base formulation is forced through the additive mixing device, where the additive ingredient is introduced into, and mixed with, a flow of the base formulation traveling through the mixing device.

In some exemplary embodiments, the additive mixing device is on the output side of the pump engine so that the base formulation remains within the pump engine ready to be pumped through the mixing device without being mixed with the additive ingredient. The additive ingredient mixing devices can be readily interchanged on the output side of the pump engine without tainting the base formulation.

In other exemplary embodiments, the additive mixing device is located between the container and the pump engine where the base formulation is drawn from the container through the additive mixing device and then the mixed formulation is pumped through the pump engine. This embodiment requires that the pump engine be integrated with the additive mixing device and becomes part of the interchangeable mixing head.

In still further exemplary embodiments, the additive mixing device is a secondary pump which co-acts with the primary base product pump to simultaneously pump both the base product formulation and the additive ingredient into a flow stream.

Other exemplary embodiments include a primary base product pump engine and a co-acting dispensing head having a nozzle, an additive ingredient chamber and a mixing chamber therebetween. Actuation of the pump engine draws the flowable base formulation from the container and pumps it through the mixing chamber where the additive ingredient is introduced into and mixed with the base formulation with each actuation.

Further exemplary embodiments include spider valves within the inlet and outlet ports, and an external cover which actively reduce leakage during shipping, handling and storage.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE EXEMPLARY EMBODIMENTS

Figure 1:
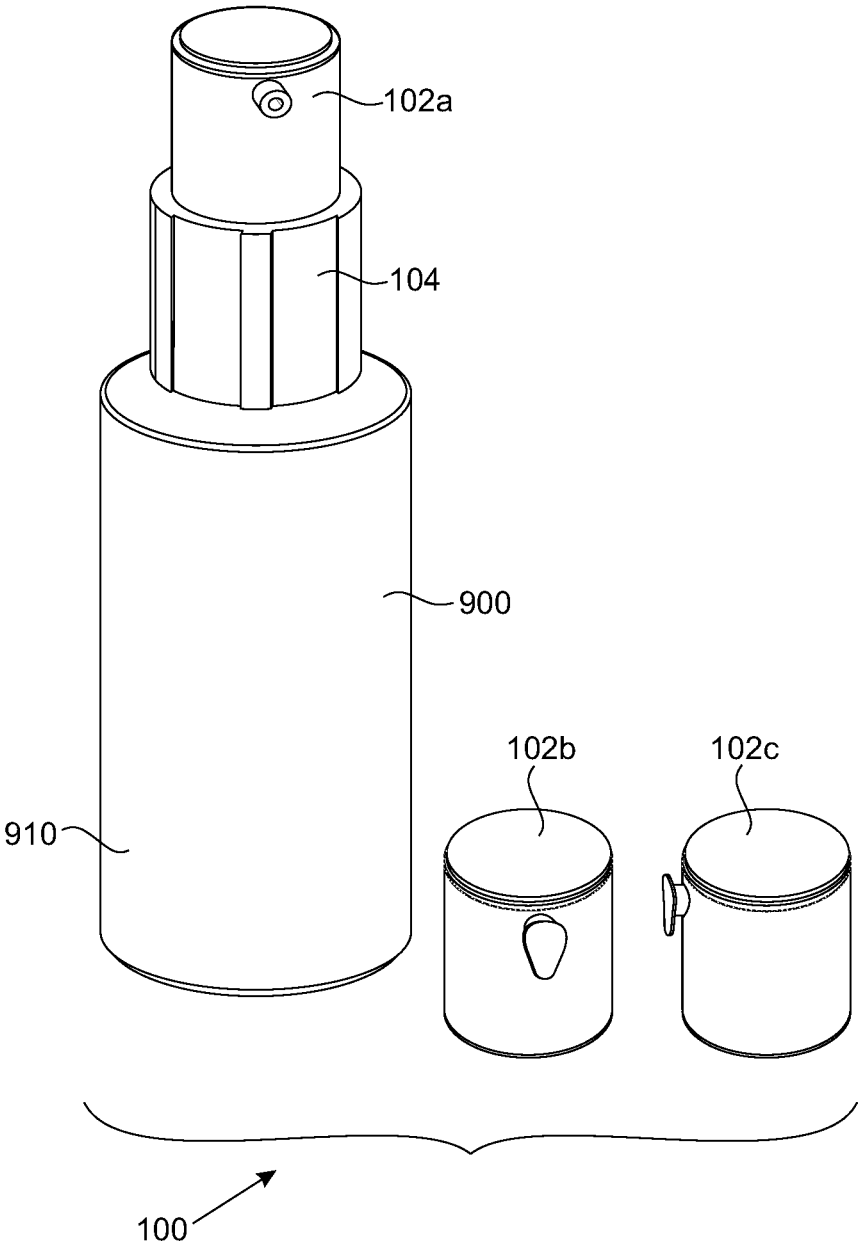
FIG. 1 illustrates a first exemplary configuration of the present dispensing system according to the teachings of the present disclosure.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

The present disclosure is generally directed to a novel additive mixing device or mixing head which is capable of both introducing and mixing an additive ingredient into a flow of a base formulation with each dispensing cycle.

In some exemplary embodiments, the additive mixing device is on the output side of the pump engine so that the base formulation remains within the pump engine ready to be pumped through the mixing device without being mixed with the additive ingredient. The additive ingredient mixing devices can be readily interchanged on the output side of the pump engine without tainting the base formulation.

In other exemplary embodiments, the additive mixing device is located between the container and the pump engine where the base formulation is drawn from the container through the additive mixing device and then the mixed formulation is pumped through the pump engine. These embodiments may require that the pump engine be integrated with the additive mixing device and becomes part of the interchangeable mixing head.

In other exemplary embodiments, primary and secondary dispensing pumps are co-active to dispense both the base formulation and the additive ingredient into a single combined stream with a single pump stroke.

In further exemplary embodiments, a pump engine and a dispensing head are co-active with each dispensing cycle.

Figure 2:
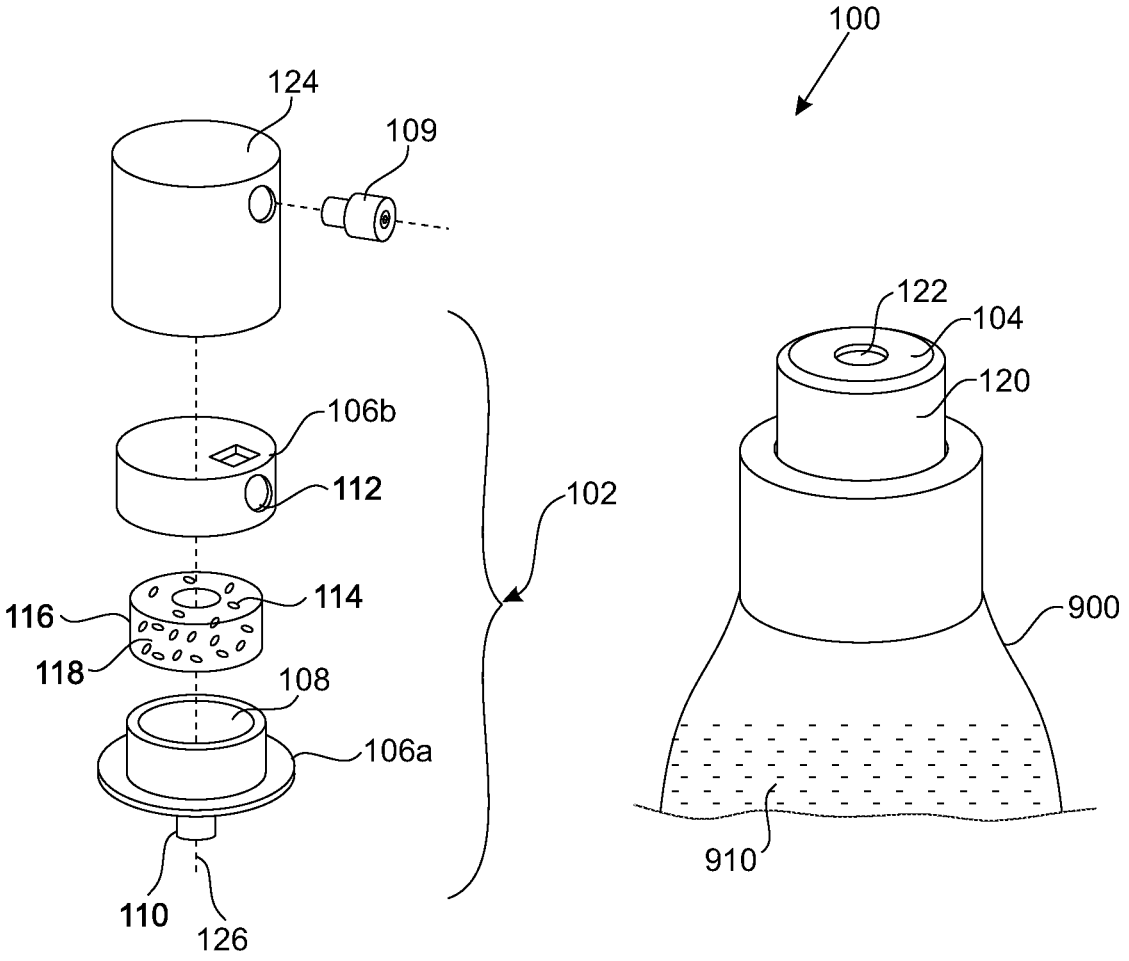
FIG. 2 illustrates an exploded perspective view thereof.

Turning to FIGS. 1-3, the present disclosure provides a dispensing system 100 including a container 900 containing a flowable base formulation 910 to be dispensed, at least one additive mixing device 102, and an actuable pump engine 104 which draws the flowable base formulation 910 from the container 900 and pumps it through the mixing device 102. In the context of a complete system, a plurality of interchangeable additive mixing devices or mixing heads 102*a*-102*n* are provided, each including a different additive ingredient which can be dispensed with the base formulation (See FIGS. 1 and 3A-3D). For example, different SPF formulations can be provided for mixing with a base sunscreen lotion or oil, or different cleaning agents for mixing with a base cleaning solution. The present examples should not be considered limiting.

The flowable base formulation 910 may include liquids, lotions, oils, gels, foams, volatile perfume base formulations, etc. Any and all formulations which are capable of being pumped with an actuable pump engine 104 are contemplated. The pump engine 104 may include any type of depressible pump or sprayer such as used for lotions, oils or perfume, or trigger pumps or sprayers, such as used for liquid cleaning products.

Referring back to FIG. 2, the additive mixing device 102 includes a body 106 with an internal cavity 108 having an input 110 and an output 112, an additive ingredient 114 impregnated or mixed within a carrier material 116 disposed within the cavity 108, and a mixing structure 118 within the cavity 108 between the input 110 and the output 112 of the cavity 108. The output 112 may include a separate nozzle 109.

The mixing device body 106 may be formed from two complementary parts 106A, 106B which may snap or screw together to form the body and cavity. The separable body parts 106A, 106B permit the additive ingredient 114, carrier 116 and mixing structure 118 to be installed into the cavity and allow for the additive ingredient to be replaced when depleted.

In some embodiments, the additive ingredient 114 is mixed with a carrier material 116 which is similar to the base formulation, such as a liquid or an oil or a gel, or with a carrier material which is soluble within the base formulation 910. In this regard, the mixing structure 118 may, for example, be an absorbent sponge material (FIG. 2) which fills the internal cavity 108 of the mixing device 102. The sponge 118 may absorb and hold a quantity of the additive ingredient 114 with its liquid/gel/oil/carrier material 116 within its pores while also providing a complex labyrinth of passageways to force mixing of the additive material 114 with the base formulation 910 as it is forced through the sponge structure 118 (See FIG. 2). In this regard, the additive ingredient 114 is carried by its carrier material 116 (liquid, etc.) which is in turn carried within the sponge 118 which functions to both hold the additive ingredient 114 as well as provide the mixing structure 118.

The pump engine 104 is mounted onto the neck of the container 900 and presents a depressible neck actuator button 120 having an output orifice 122. A dispensing pump of the type described in US Patent Publication No. 20170197226 is exemplary, the entire contents thereof being incorporated herein by reference. The mixing device 102 includes a complementary shape with an overcap 124 which fits over the pump neck 120 and centrally located input tube 126 which is received into the pump output 122.

Figure 3A:
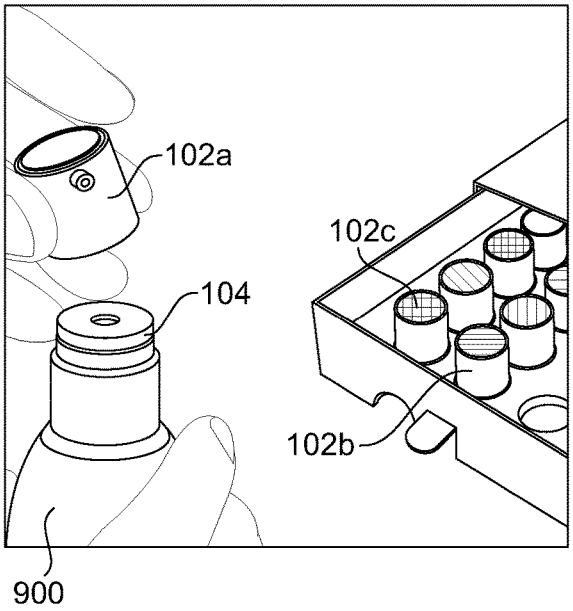
FIGS. 3A-3D illustrate an exemplary use of the present dispensing system including selection of a first desired additive, dispensing of the base formulation with the first selected additive (color added for effect), selection of a second desired additive, and dispensing of the base formulation with the second selected additive (color added for effect)
Figure 3B:
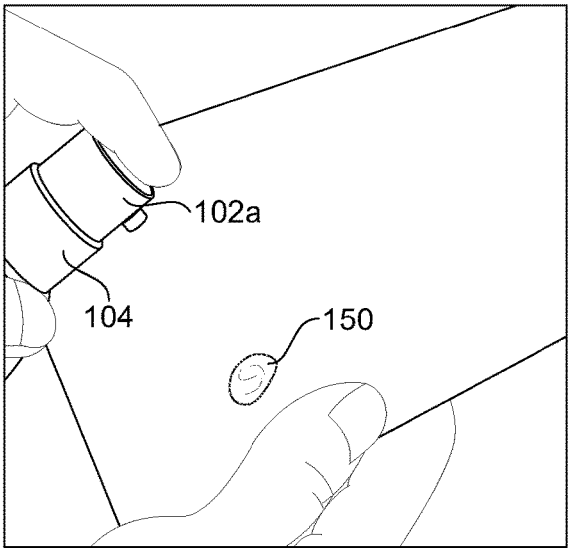
Figure 3C:
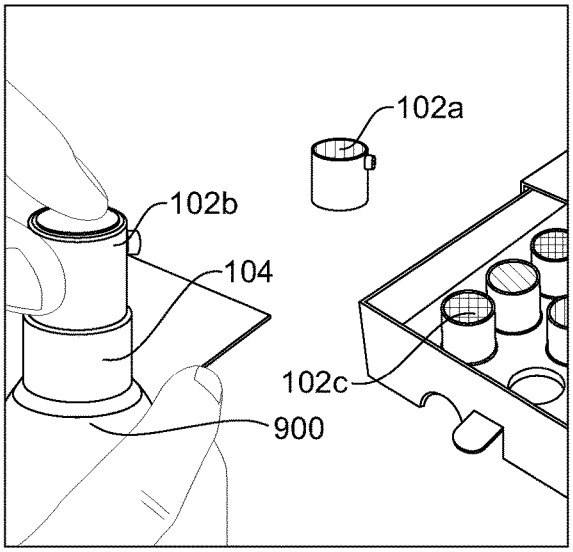
Figure 3D:
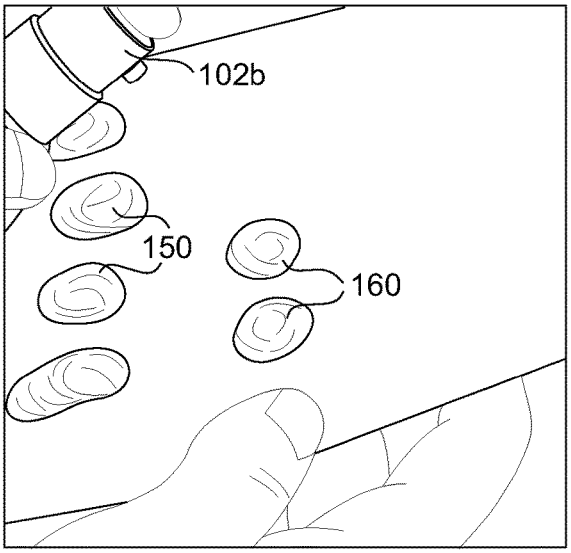

FIGS. 3A-3D illustrate an exemplary system which includes a plurality of dispensing heads (additive mixing heads 102*a*-102*n*) for a button pump system of the type generally illustrated in FIGS. 1-2. The container 900 holds a base formulation 910 while each of the mixing devices (mixing heads) 102 includes a different additive formula. When the mixing head 102*a* is depressed, the pump engine 104 draws the base formulation 910 from the container 900 and forces it through the additive mixing head 102 to provide a first fully mixed formulation 150 (FIG. 3B). FIG. 3C-3D illustrate a second mixing head 102*b* with a second SPF formulation. The first mixing head 102*a* is removed and the second mixing head 102*b* installed to provide the new fully mixed formulation 160. In the meantime, the base formulation in the container 910 has not been altered or tainted with the additive ingredients.

Figure 4:
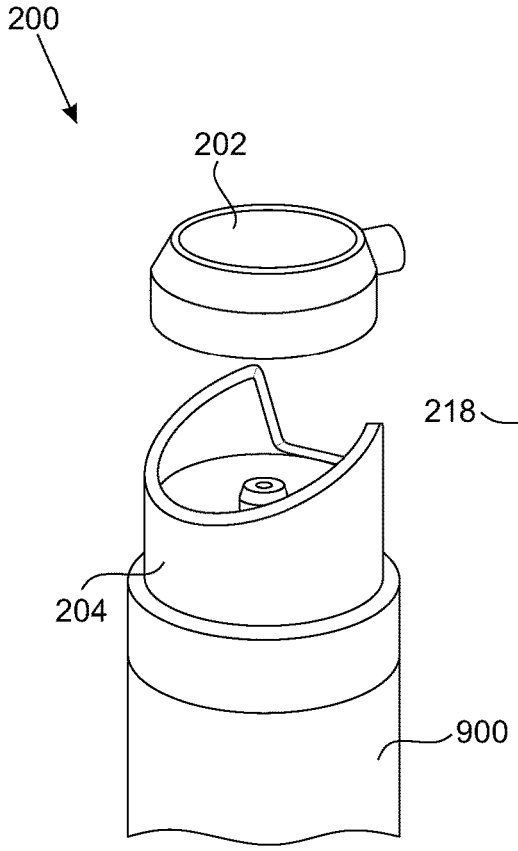
FIG. 4 illustrates another exemplary embodiment with a different style additive mixing device.
Figure 5:
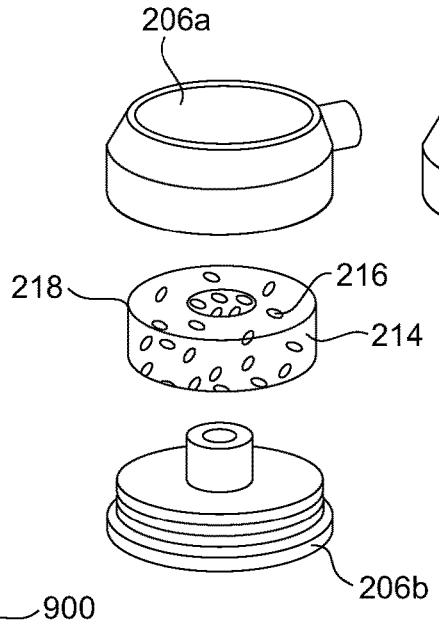
FIG. 5 is an exploded view of the device in FIG. 4.
Figure 6:
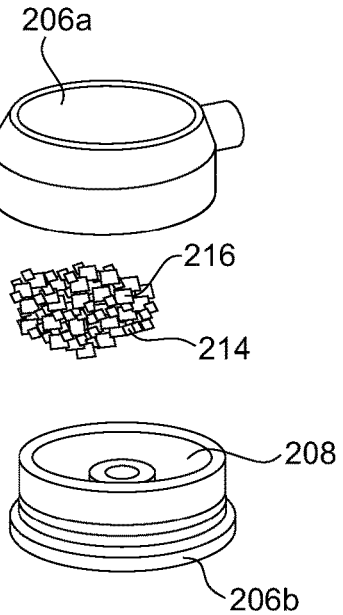
FIG. 6 is an exploded view of yet another example of the additive mixing device.

FIGS. 4-6 illustrate an alternative embodiment system 200 which includes a different style additive mixing device 202 for a similar button type pump engine 204. In FIG. 5, the additive ingredient 214 is carried in a liquid/gel/oil 216 absorbed into sponge 218 which services as the mixing structure.

Referring to FIG. 6, in some embodiments, the additive ingredient 214 may be impregnated into a solid carrier material 216, which may include crystals, small pills, beads, balls, or larger shapes which fill the cavity and have through holes, apertures, slots, channels or other flow structures to provide for increased surface area for fluid flow and contact with the additive ingredient.

The solid crystals 216 may fill the cavity 208 or be contained within a replaceable netting material (not shown) and placed within the cavity 208. The uneven shapes and structures of the crystals 216 creates the necessary turbulent pathways to cause sufficient mixing of the additive ingredient 214 into the flow of the base formulation 910 as it passes over the crystals 216.

Figure 7:
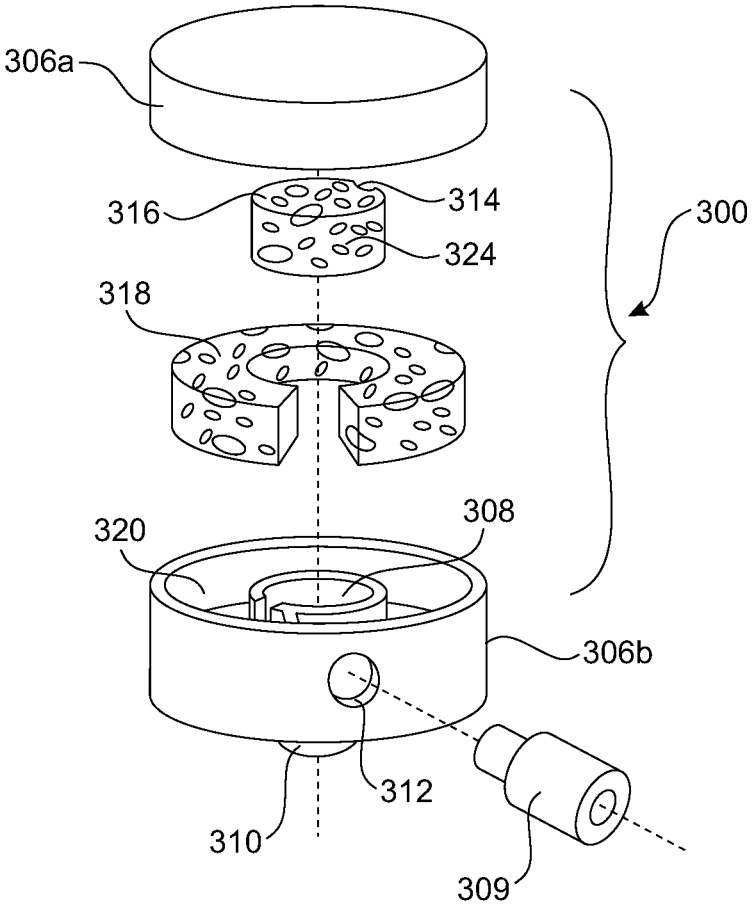
FIG. 7 is an exploded view of still another exemplary embodiment of the additive mixing device.
Figure 8:
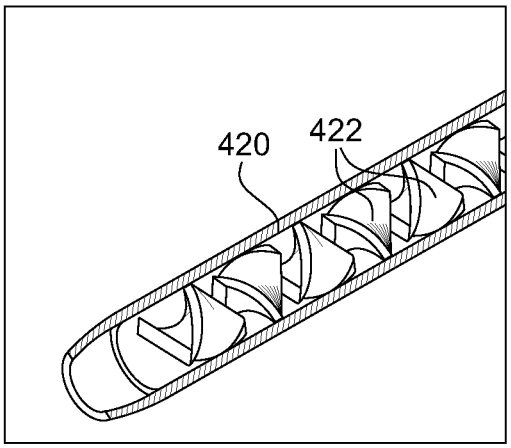
FIG. 8 is a cross-sectional view of a baffle type mixing structure within a mixing passage.

Still other embodiments 300 and 400, such as illustrated in FIGS. 7 and 8, may include a separate mixing passage 320 with interior baffles or other structures adjacent to the cavity output 312 to create a turbulent mixing of the base formulation 910 and additive ingredient 314 as the combined materials pass through the mixing passageway 320 to the output 312 and nozzle 309.

In the embodiment system 300 illustrated in FIG. 7, the additive ingredient 314 and it's liquid/gel/oil carrier 316 may be absorbed into a separate sponge carrier 324 which is located in a cavity 308 adjacent to the input 310, and a second mixing sponge 318 may be fitted within an elongated mixing passage 320 extending from the input cavity 308 to the output 312.

FIG. 8 illustrates another exemplary mixing passage 420 and baffle structure 422 which could replace the passage 320 and mixing sponge 318.

With each pump of the illustrated pump engines, the base formulation 910 is forced through the additive mixing device, where the additive ingredient is introduced into, and mixed with, a flow of the base formulation traveling through the mixing device.

Figure 9:
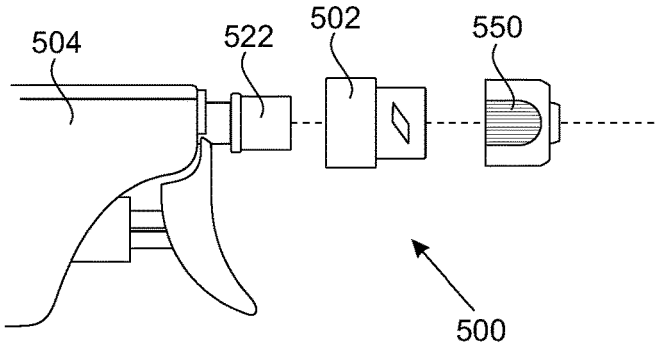
FIG. 9 illustrates an exemplary trigger sprayer embodiment.
Figure 10:
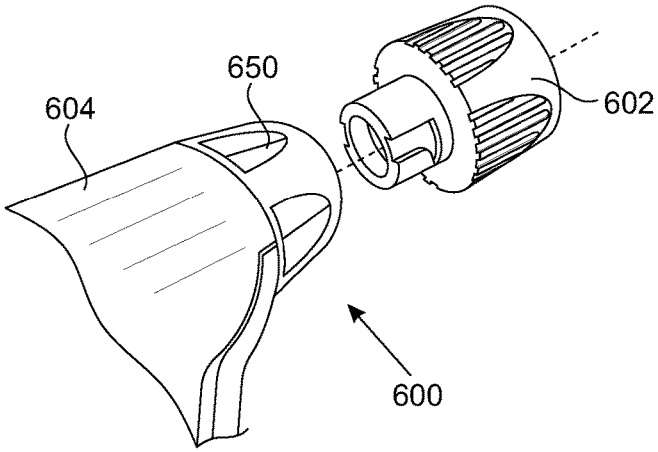
FIG. 10 illustrates another exemplary trigger sprayer embodiment.
Figure 11:
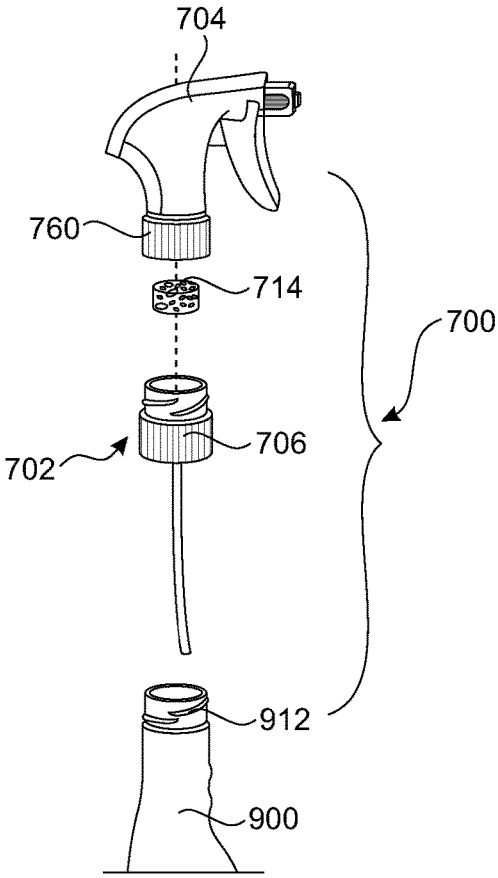
FIG. 11 illustrates yet another exemplary trigger sprayer embodiment with the additive mixing device between the container and the trigger pump.

Turning to FIGS. 9-11, various trigger sprayer embodiments are disclosed. In FIG. 9, a trigger spray dispensing system 500 includes a trigger spray pump 504 which is provided with an additive mixing device 502 received on the output 522 of the spray head of the trigger pump 504. The additive mixing device 502 includes complementary attachment formations to allows its installation between the trigger spray head output 522 and a nozzle 550. Configuration and operation are the same as described hereinabove for the pump dispenser.

In FIG. 10, An embodiment 600 includes a similar trigger sprayer 604. The additive mixing device 602 is provided as an adapter body which is selectively fitted to the output of the spray nozzle 650.

In FIG. 11, there is illustrated an exemplary embodiment 700, where the additive mixing device 702 is installed between the container 900 and the trigger pump 704. The additive mixing device 702 may be a one-piece body with an open top cavity. The body 706 may be inwardly threaded at the input side for mounting on the neck 912 of the container 900 and outwardly threaded on the output side for mounting to the base 760 of the trigger sprayer 704. As noted above, this type of embodiment may require that the pump engine (trigger or button) be integrated with the additive mixing device so that it becomes part of the interchangeable mixing head.

Figure 12:
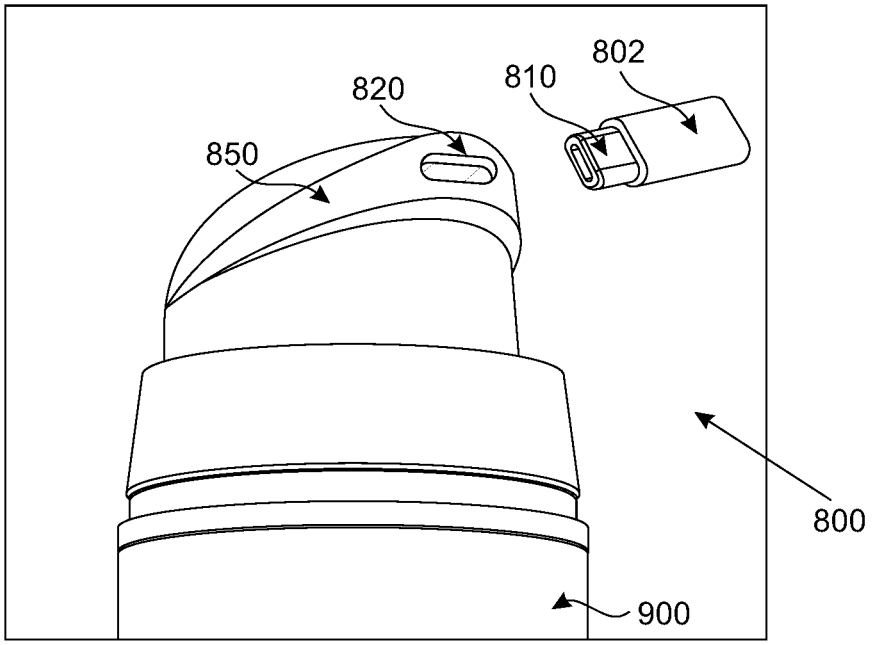
FIG. 12 illustrates a further exemplary dispensing system with a plug type additive mixing device which can be installed at the output of a dispenser.

Turning to FIG. 12, there is illustrated yet another embodiment 800 where the additive mixing device 802 is configured as a tubular nozzle with a plug fitting 810 for installation on the output 820 of a pump nozzle 850.

Figure 13:
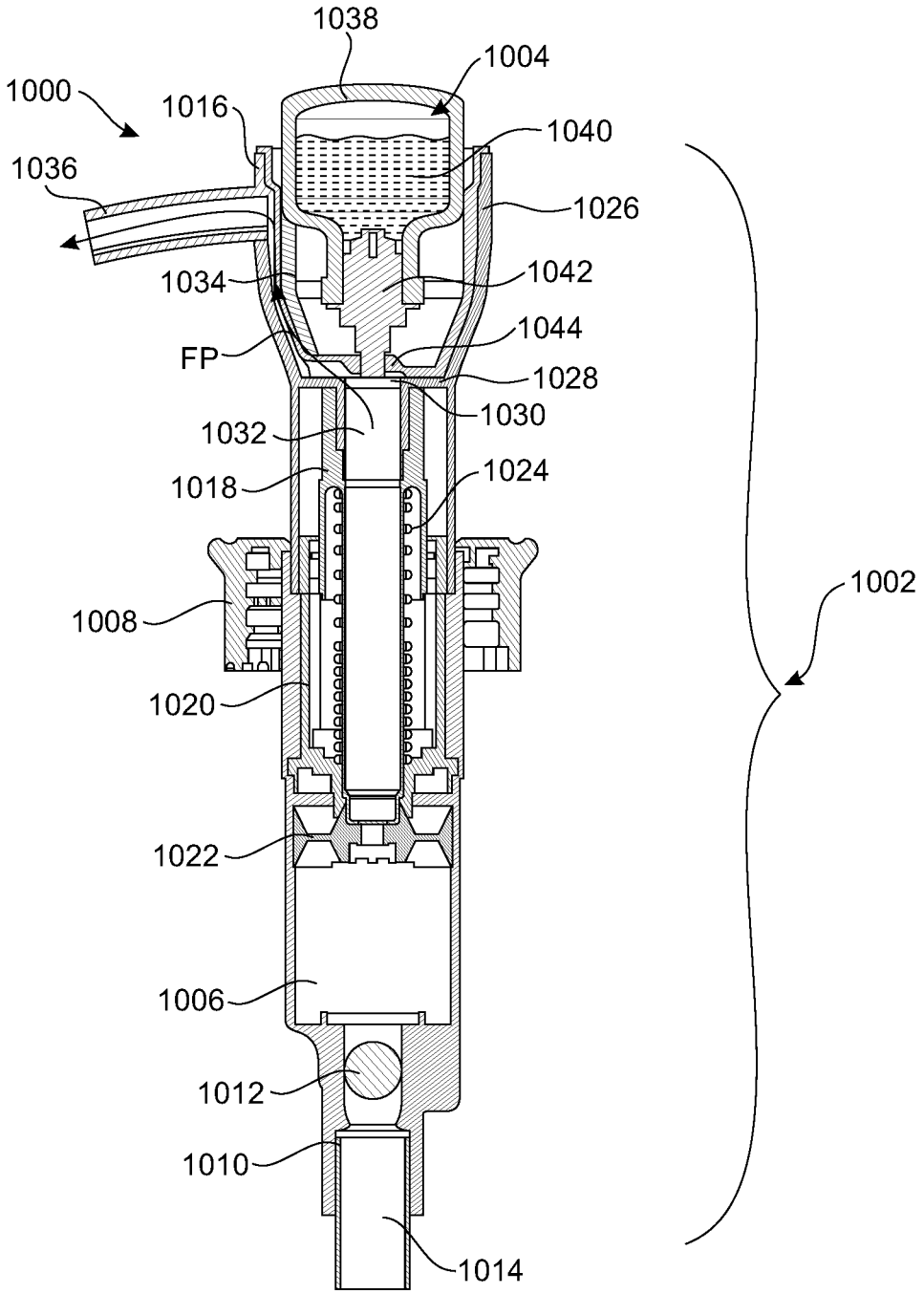
FIG. 13 illustrates yet a further exemplary dispensing system with a primary dispensing pump and a secondary additive pump.

FIGS. 13-14 illustrate yet a further embodiment with co-acting primary and secondary pumps. A dispensing assembly 1000 generally includes a primary base product pump 1002 and a secondary additive ingredient pump 1004.

The base product pump 1002 comprises an accumulator cup 1006 which is secured within the neck of a container 900 with a threaded closure 1008. The accumulator 1006 has a dip tube inlet 1010 formed in the bottom wall thereof. A ball valve 1012, or other fluid valve structure is disposed within the dip tube inlet 1010 and a dip tube 1014 extends from the inlet 1010 to draw base product 910 from the container 900.

A nozzle head 1016 is received on a piston stem 1018 which extends through the closure 1008 and into the accumulator 1006. The piston stem 1018 is axially guided within the accumulator 1006 by a piston guide 1020. The piston stem 1018 extends through the bottom of the piston guide 1020 and a piston seal 1022 is received on the terminal end of the piston stem 1018, forming a seal with the inner walls of the accumulator 1006. A spring 1024 is captured between the piston guide 1020 and the piston stem 1018 to axially bias the head 1016 upwardly.

The nozzle head 1016 includes an upwardly open receptacle 1026 for removably receiving the additive ingredient pump 1004. The receptacle 1026 has a bottom wall 1028 with an aperture 1030 that opens into a mixing chamber 1032 which is in turn received into the exit opening of the piston stem 1018. A cup shaped guide sleeve 1034 is received within the pump head receptacle 1026 and cooperates with the pump head 1016 to define a fluid flow path (see arrow FP) from the mixing chamber 1032 to the discharge nozzle 1036.

The additive ingredient pump 1004 has a body 1038 which contains the additive ingredient 1040 and an axial, spring biased dispensing stem 1042 extending from the body 1038. As noted above, the additive ingredient 140 may be mixed with a carrier material to provide a mixture which can be pumped or sprayed. When received into the pump receptacle 1026, the dispensing stem 1042 is received into an aperture 1044 in the bottom of the guide sleeve 1034 and communicates with the mixing chamber 1032. The body 1038 is guided for axial movement within the guide sleeve 1034 by the walls of the guide sleeve 1034.

In operation, a forcible downward compression of the additive pump 1004 and nozzle head 1016 causes two simultaneous pumping actions. For the additive pump 1004, the dispensing stem 1042 is axially compressed to dispense a metered dose of the additive ingredient 1040 into the mixing chamber 1032. Simultaneously, the same downward compression forces the piston stem 1018 downwardly to pump the base product 910 from the accumulator cup 1006 up through the piston stem 1018 and into the mixing chamber 1032. The final portion of the compression stroke forces the mixed base product and additive ingredient in the mixing chamber 1032 through the flow path (FP) and out through the discharge nozzle 1036.

Figure 14A:
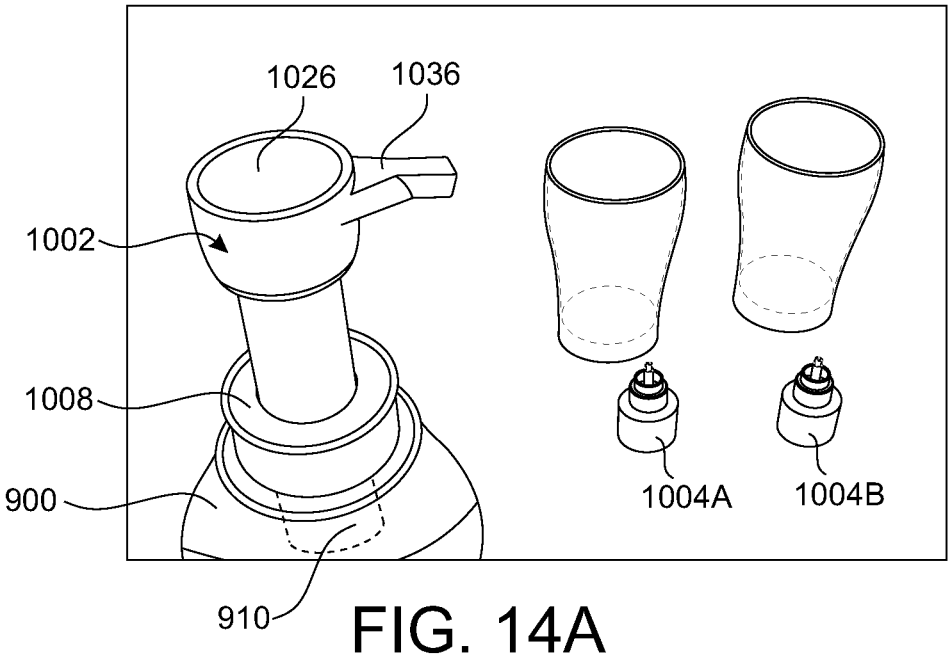
FIGS. 14A-14D illustrate an exemplary use of the dispensing system of FIG. 13 including selection of a first desired additive, dispensing of the base formulation with the first selected additive (color added for effect), selection of a second desired additive, and dispensing of the base formulation with the second selected additive (color added for effect).
Figure 14B:
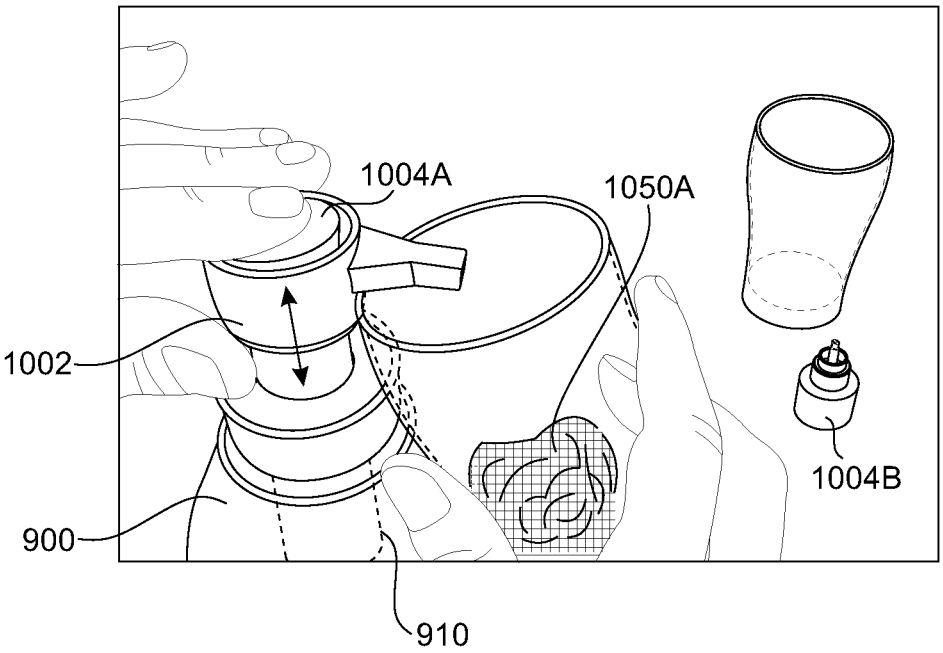
Figure 14C:
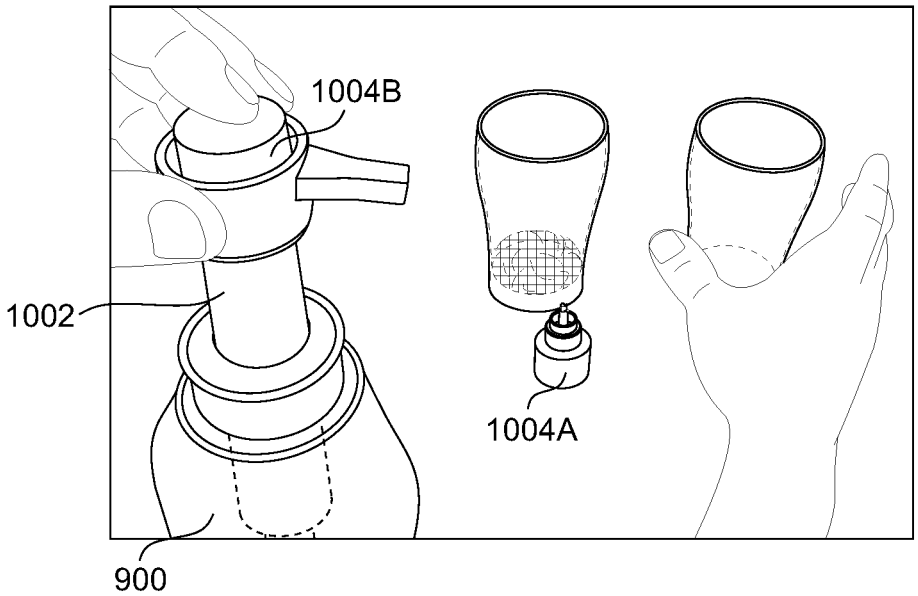
Figure 14D:
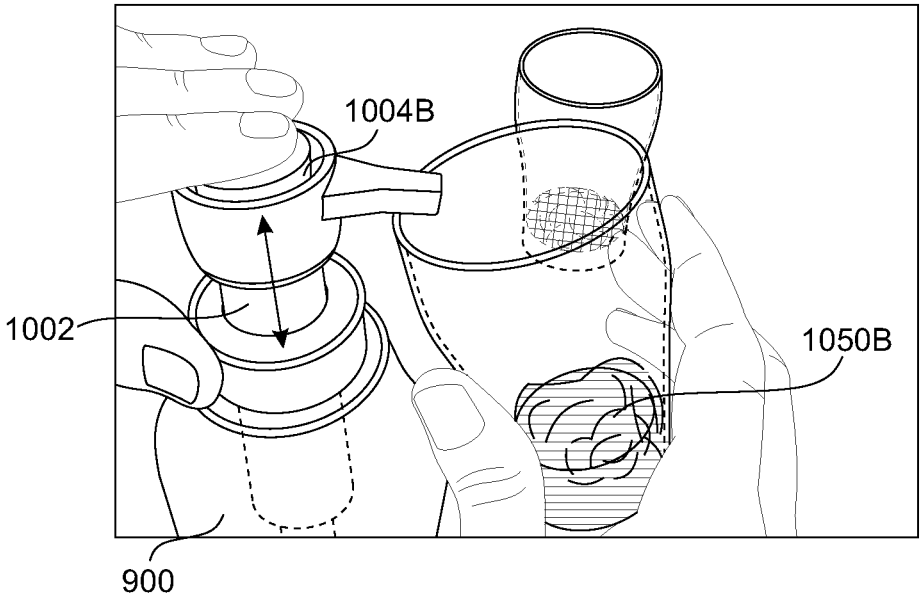
Figure 15:
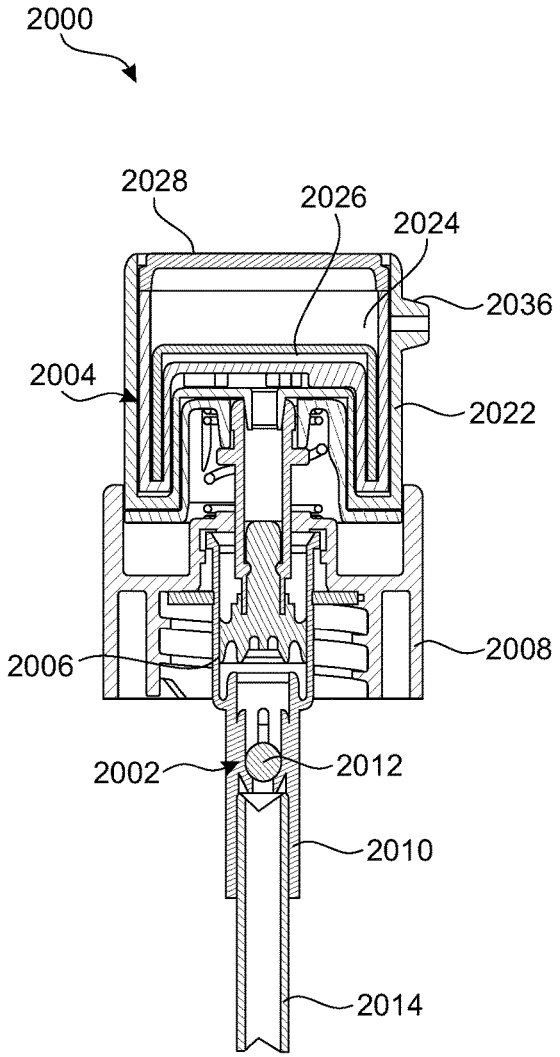
FIG. 15 illustrates an exemplary embodiment shown in cross-section with a pump engine and a co-acting dispensing head.

FIGS. 14A-14D illustrate the exemplary system which includes a plurality of additive pumps 1004A, 1004B for the dispensing system 1000 as generally illustrated in FIG. 13. The container 900 holds a base formulation 910 while each of the additive pumps 1004A, 1004B includes a different additive formulas A and B. When the additive pump 1004A is installed and depressed, the additive pump 1004A dispenses the additive ingredient A into the mixing chamber 1032 while the primary pump 1002 also draws the base formulation 910 from the container 900 and forces it through the piston stem 1018 into the mixing chamber 1032 and then further through the dispensing flow path (FP) to the nozzle 1036 to provide a fully mixed formulation 1050A (FIG. 14B). FIG. 14C-14D illustrate a second additive pump 1004B with a second formulation B. The first additive pump 1004A is removed and the second additive pump 1004B is installed to provide the new fully mixed formulation 1050B (FIG. 14D). In the meantime, the base formulation 910 in the container 900 has not been altered or tainted with the additive ingredients A and B.

FIGS. 15-28F illustrate further exemplary embodiments with a primary pump engine and a co-acting dispensing head. Referring to FIGS. 15-19C, a dispensing system 2000 in accordance with this exemplary embodiment generally includes a primary pump engine assembly 2002 and a co-acting dispensing head 2004.

The pump engine 2002 assembly comprises an accumulator cup 2006 which is secured within the neck of a container 900 (shown in FIG. 28A) with a closure 2008 that engages with the neck of the container. In some embodiments, the closure 2008 may be threaded as illustrated. The accumulator 2006 has a clip tube inlet 2010 formed in the bottom wall thereof. A ball valve 2012, or other fluid valve structure is disposed within the clip tube inlet 2010 and a clip tube 2014 extends from the inlet 2010 to draw base product 910 from the container 900.

The dispensing head assembly 2004 is received onto a piston stem 2016 of the pump engine 2002 which extends through an axial opening in the closure body 2008. A spring 2018 is captured between the upper surface of the closure body 2008 and a bottom surface of a guide flange 2020 to axially bias the dispensing head assembly 2004 upwardly.

The dispensing head assembly 2004 comprises a nozzle body 2022 with an upwardly open receptacle which co-axially receives a nozzle core 2024 and an inverted cup shaped piston 2026. A cap 2028 is removably received onto the nozzle body 2022 over the open receptacle. The nozzle body 2022 has an outer side wall 2030 and a bottom wall 2032 which is recessed up into the interior of the body. This creates an annular channel 2034 into which the nozzle core 2024 and piston 2026 are received.

Figure 16:
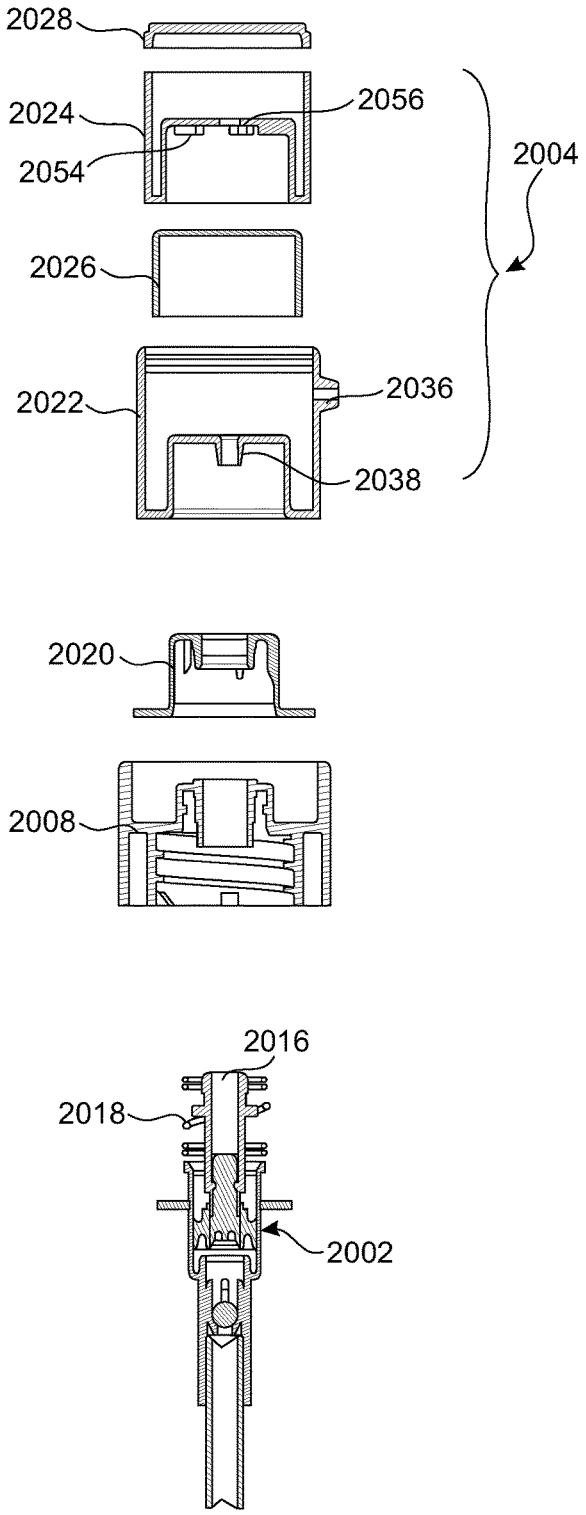
FIG. 16 is an exploded cross-sectional view thereof.
Figure 17:
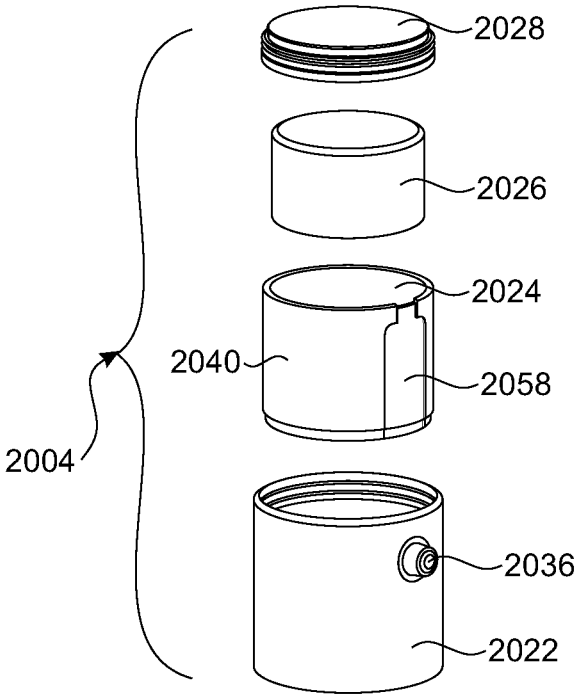
FIG. 17 is an exploded view of the dispensing head components.
Figure 18:
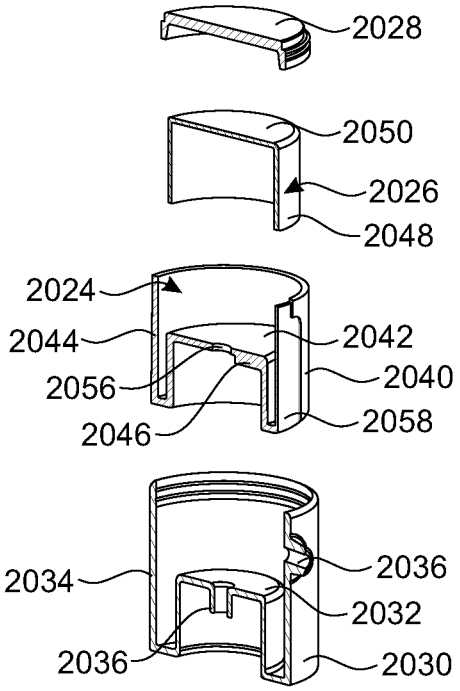
FIG. 18 is a cross-sectional view thereof taken along line 18-18 of FIG. 17.

The outer side wall 2030 of the nozzle body 2022 includes a dispensing orifice 2036 adjacent the upper peripheral edge thereof. The bottom wall 2032 of the nozzle body 2022 includes a connection port 2038 extending through the bottom wall 2032 and downwardly. As best seen in FIG. 16, the connection port 2038 is removably press fit into the piston stem 2026 of the pump engine 2002. [96] The nozzle core 2024 includes a side wall 2040 and a bottom wall 2042 which is also recessed upwardly into the interior of the core creating an annular piston seat 2044 within the nozzle core 2024. The nozzle core 2024 nests within the nozzle body 2022 where the bottom surface of the bottom wall 2042 includes spacing shoulders 2046 to create a narrow base product flow path beneath the upper surface of the bottom wall 2032 of the nozzle body 2022 and the lower surface of the bottom wall 2042 of the nozzle core 2024. The piston 2026 nests within the nozzle core 2024 with its sidewalls 2048 received in the annular piston seat 2044, and its top wall 2050 resting on the bottom wall 2042 of the nozzle core 2024. This creates an active ingredient chamber 2052 above the top wall 2050 of the piston 2026. An active ingredient formulation 2054 (liquid, gel, lotion etc.) may be received into the chamber 2052. The active ingredient formulation 2054 may include a carrier material which facilitates a fluid flow. The cap 2028 is snap received into the upper lip of the nozzle body 2022 where its sidewalls engage the sidewalls of the nozzle core 2024 and retain the nozzle core 2024 in position within the nozzle body 2022. The cap walls and nozzle body lip may include interfitting snap formations to facilitate removal of the cap 2028, as well as filling and refilling of the additive ingredient formulation 2054.

A flow aperture 2056 is provided in the bottom wall 2042 of the core 2024, allowing base product 910 to flow into a lower base product chamber space (best seen in FIGS. 26B-26C) beneath the piston 2026. The outside surface of the nozzle core 2024 includes a recessed flow channel 2058 extending from the upper lip to the bottom edge. The upper portion of the channel 2058 is narrower and provides a flow path for the active ingredient 2054 to flow from the inside of the nozzle core 2024, up and over the lip and into the channel 2058 to the aligned dispensing orifice 2036. The bottom portion of the channel 2058 is wider and provides a flow path for the base product 910 to flow from beneath the nozzle core 2024, up and around the bottom edge into the channel 2058 to the aligned dispensing orifice 2036. The active ingredient 2054 and the base product 910 meet adjacent to the dispensing orifice 2036 and are mixed as the exit through the dispensing orifice 2036. The nozzle core 2024 and nozzle body 2022 are keyed (not shown) for alignment of the active ingredient flow passage/mixing channel/chamber 2058 with the dispensing orifice 2036.

Figure 19A:
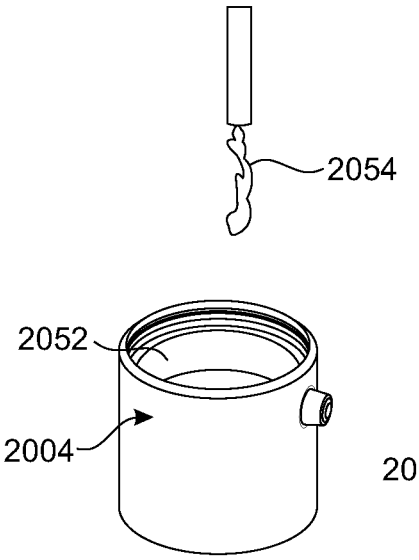
FIGS. 19A-C illustrate a filling sequence of the dispensing head.
Figure 19B:
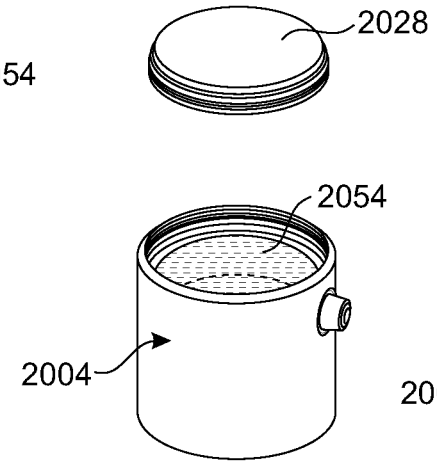
Figure 19C:
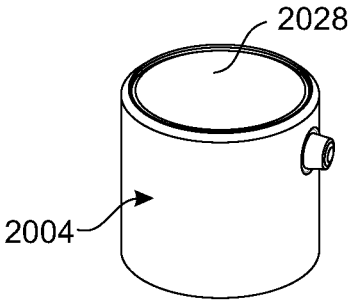
Figure 20:
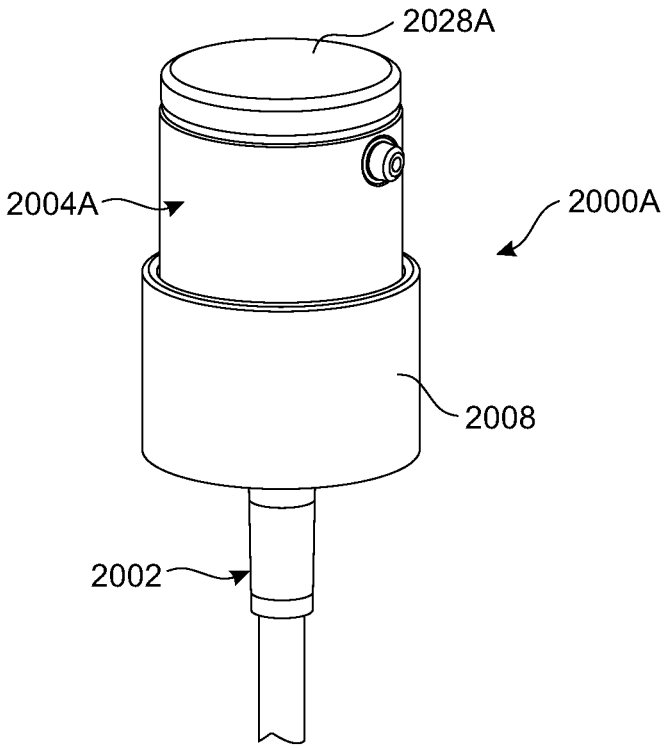
FIG. 20 illustrates yet another exemplary embodiment with a pump engine and a co-acting dispensing head.
Figure 21:
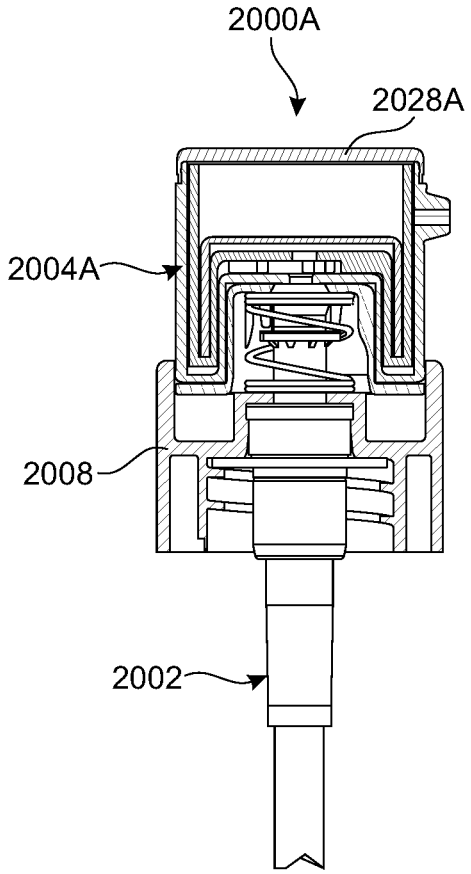
FIG. 21 is a cross-sectional view thereof taken along line 21-21 of FIG. 20.
Figure 23:
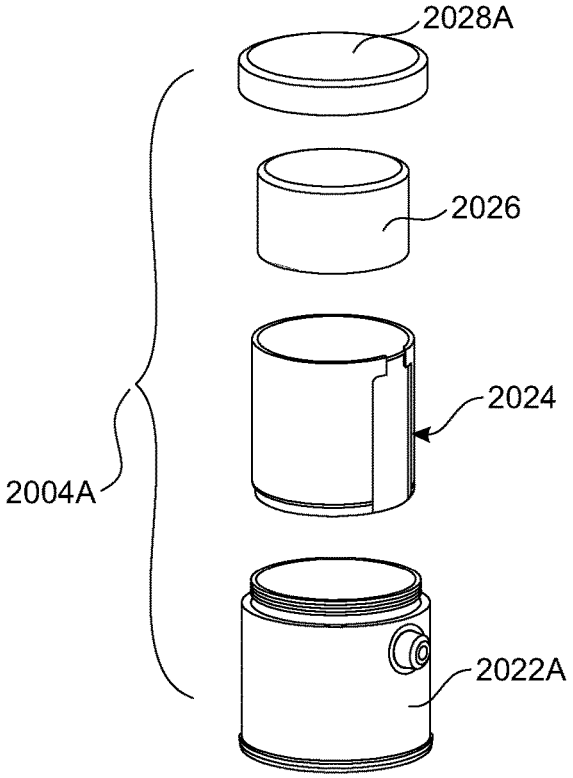
FIG. 23 is a partially exploded view of the dispensing head components.
Figure 23:
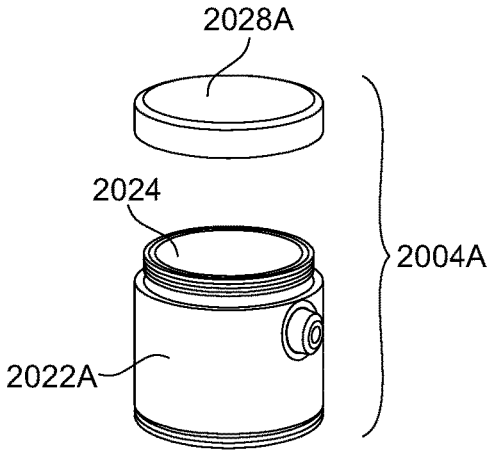
Figure 22:
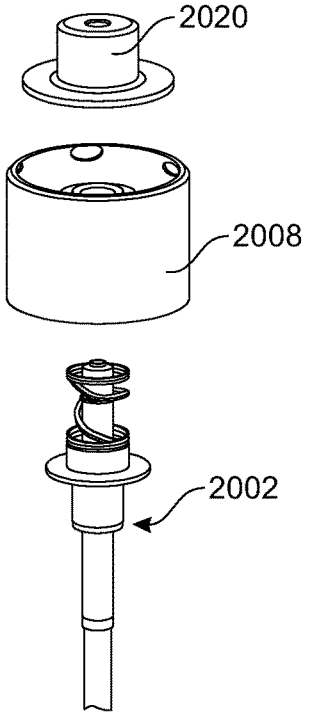
FIG. 22 is an exploded view of the dispensing head, closure, guide and pump engine.
Figure 24:
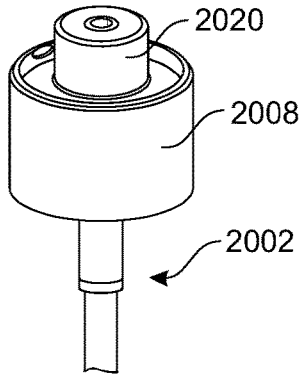
FIG. 24 is a perspective view of the pump engine, closure body and guide flange sub-assembly.

Referring briefly, to FIGS. 19A-C, a filling sequence is illustrated, wherein the cap 2028 is disassembled from the nozzle body 2022 and the active ingredient 2054 is filled into the chamber 2052 (FIG. 19A). in FIGS. 19-B-C, the cap 2028 is replaced to close the chamber 2052.

As the pump engine 2002 is actuated, i.e. by pressing downwardly on the top of the dispensing head 2004, base product 910 flows from the piston stem 2016 beneath the nozzle core 2024 to the dispensing orifice 2036. A small amount of base product also flows through the flow aperture 2056 to the lower chamber space beneath the piston 2026. With each actuation, a lower base product chamber 2060 is created beneath the piston 2026, filling with base product 910 and pushing the piston 2026 upwardly to simultaneously push the active ingredient 2054 from the upper chamber 2052. This flow action will be described further hereinbelow with respect to FIGS. 26A-26C.

Figure 25A:
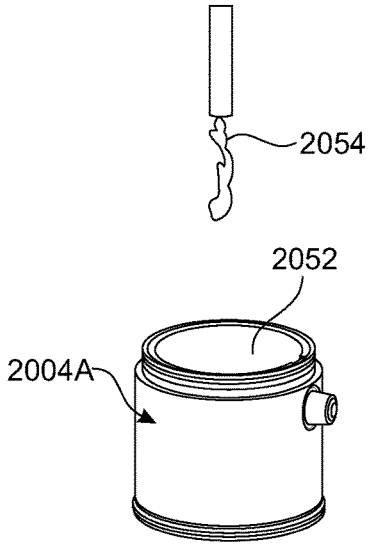
FIGS. 25A-C illustrate a filling sequence of the dispensing head.
Figure 25B:
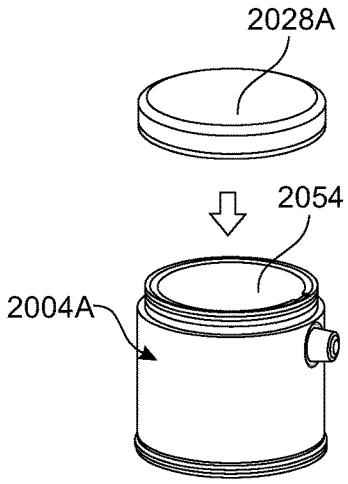
Figure 25C:
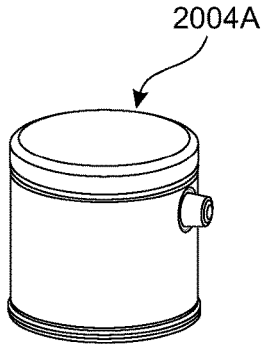

Referring now to FIGS. 20-25C, a nearly identical embodiment 2000A is illustrated with the minor exception of an alternative cap 2028A being received around the outside surface of the nozzle body 2022. Such a construction may facilitate removal of the cap 2028A in refilling situations. FIGS. 25A-25C illustrate filling or refilling of the dispensing head 2004A.

Figure 26A:
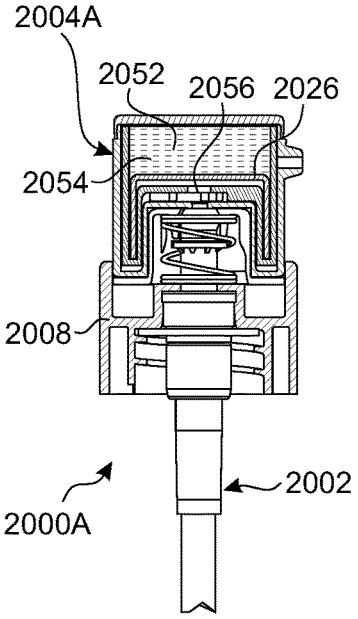
FIGS. 26A-C illustrate an exemplary flow sequence dispensing cycle.
Figure 26B:
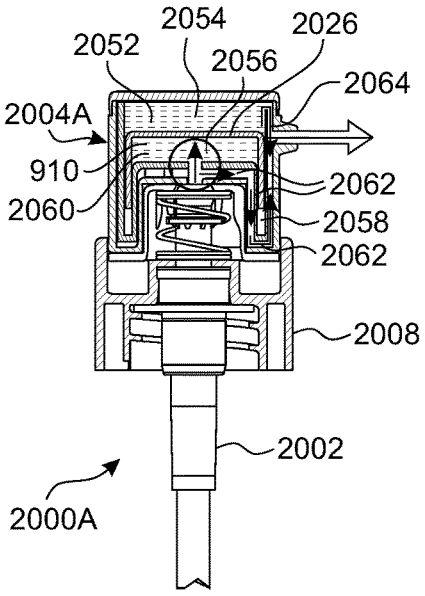
Figure 26C:
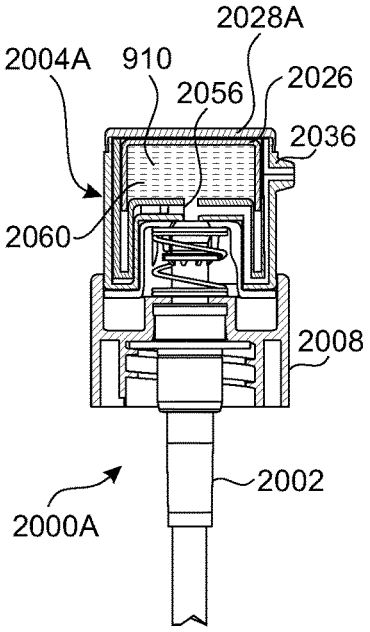
Figure 28A:
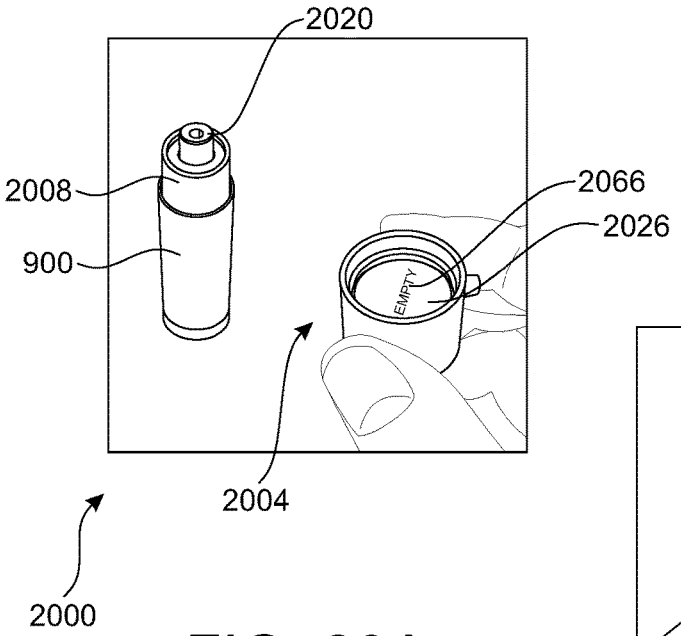
FIGS. 28A-F illustrate an exemplary use of the dispensing system including filling of the dispensing head (28A-C), mounting of the dispensing head onto the pump engine (28D), dispensing of the product (28E) and an empty dispensing head after repeated dispensing cycles (28F)

Turning to FIGS. 26A-26C, a progression of the dispensing sequence and gradual metering of the active ingredient formulation 2054 is illustrated. The illustrations are shown relative to the embodiment 2000A with the over cap configuration. However, the functional aspects are identical in both embodiments 2000 and 2000A. FIG. 26A illustrates the starting configuration of the dispensing system 2000A with the active product chamber 2052 initially filled. The piston 2026 is fully seated within the nozzle core 2024, and there is no base product 910 beneath the piston 2026. As described above, as the pump engine 2002 is actuated (FIG. 26B, i.e. by pressing downwardly on the top of the dispensing head 2004, base product 910 flows from the piston stem 2016 beneath the nozzle core 2024 to the dispensing orifice 2036 (see flow path arrows 2062). A small amount of base product 910 also flows through the flow aperture 2056 to the space 2060 beneath the piston 2026 which simultaneously pushes the active ingredient 2054 from the upper chamber 2052 over the nozzle core side wall 2040 to the dispensing orifice 2036 (see flow path arrows 2064). With each actuation, the lower base product chamber 2060 is increased in size beneath the piston 2026, filling with base product 910 and pushing the piston 2026 upwardly. After numerous dispensing cycles, the active ingredient chamber 2052 empties while the base product lower chamber 2060 fills, and eventually the piston wall 2050 will meet with the cap 2028. As seen in FIGS. 28A and 28F, the cap 2028 can be made of a transparent or translucent material and graphical indicator markings 2066 can be placed on the piston wall 2050 to indicate to the user that the active ingredient chamber 2052 is "empty".

Figure 27A:
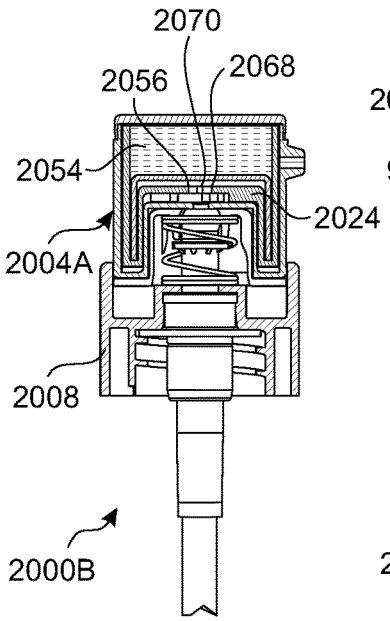
FIGS. 27A-C illustrate an alternative exemplary embodiment and flow sequence where the flow path into the lower chamber is adjusted with a flow restrictor insert.
Figure 27B:
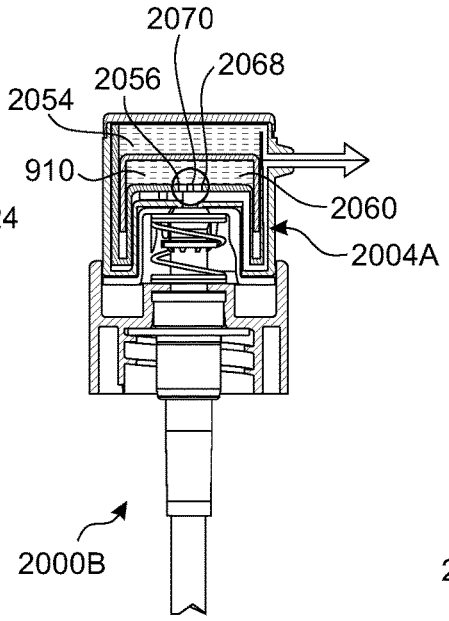
Figure 27C:
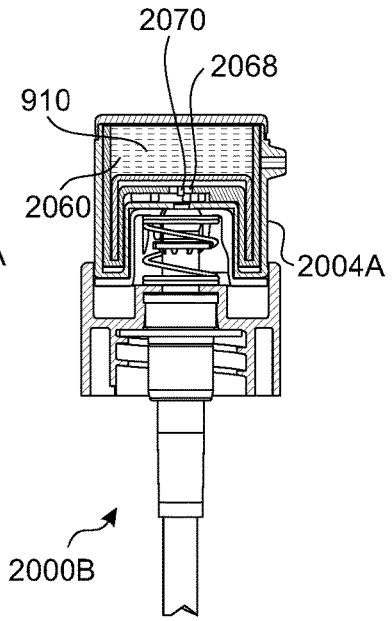

Turning now to FIGS. 27A-27C another nearly identical embodiment 2000B is illustrated. Embodiment 2000B includes the over cap configuration of 2000A with the addition of a flow restrictor insert 2068 which may be received within the flow aperture 2056 in the bottom wall 2042 of the nozzle core 2024. The insert 2068 may be snap received into the flow aperture 2056 and may include a smaller flow aperture 2070 to restrict the flow and control the amount of active ingredient 2054 dispensed. By controlling how much base product 910 enters the lower chamber 2060, the manufacturer can control the dosing or metering of the active ingredient mixture 2054 from the upper ingredient chamber 2052. Multiple inserts with different size flow apertures may be provided to adjust dosing.

In some embodiments, the insert 2068 may also be received within the connection port 2038 in the bottom wall 2032 of the nozzle body 2022 (configuration not shown).

Figure 28B:
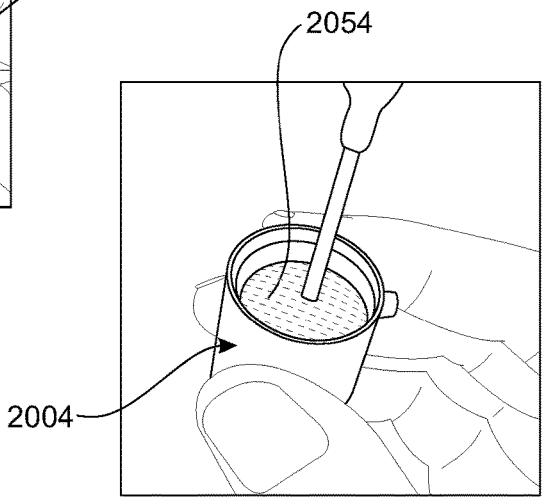
Figure 28C:
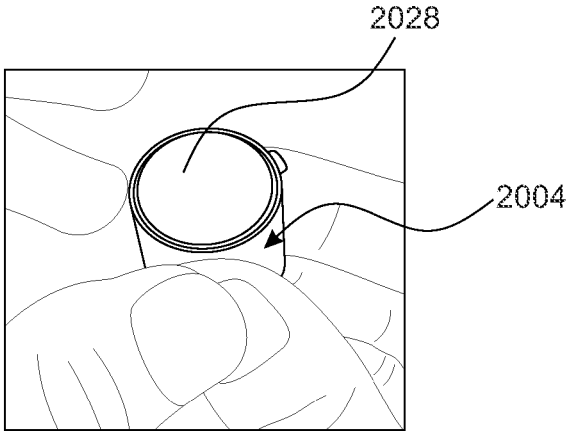
Figure 28D:
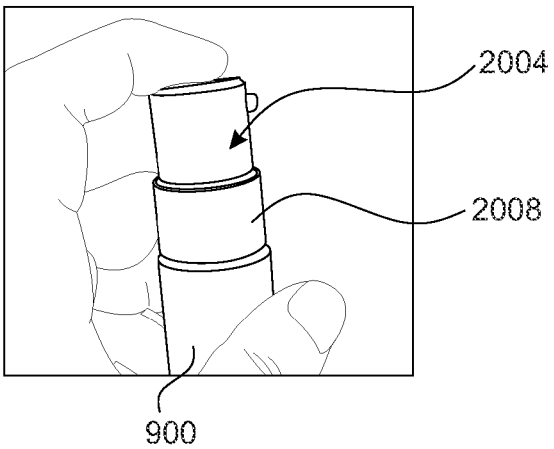
Figure 28E:
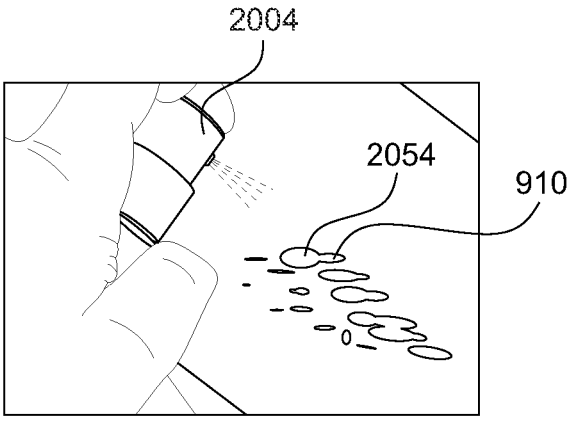
Figure 28F:
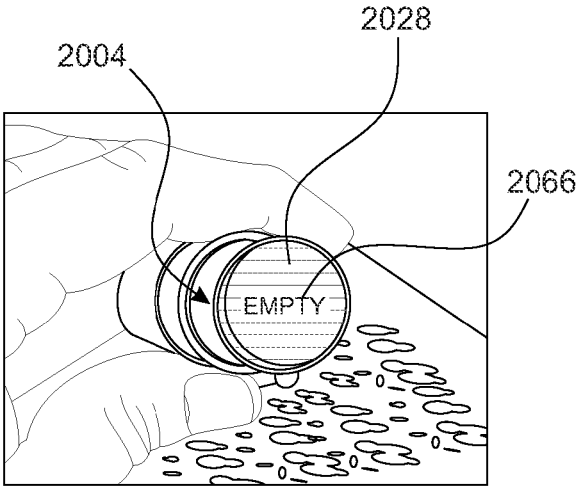
Figure 29:
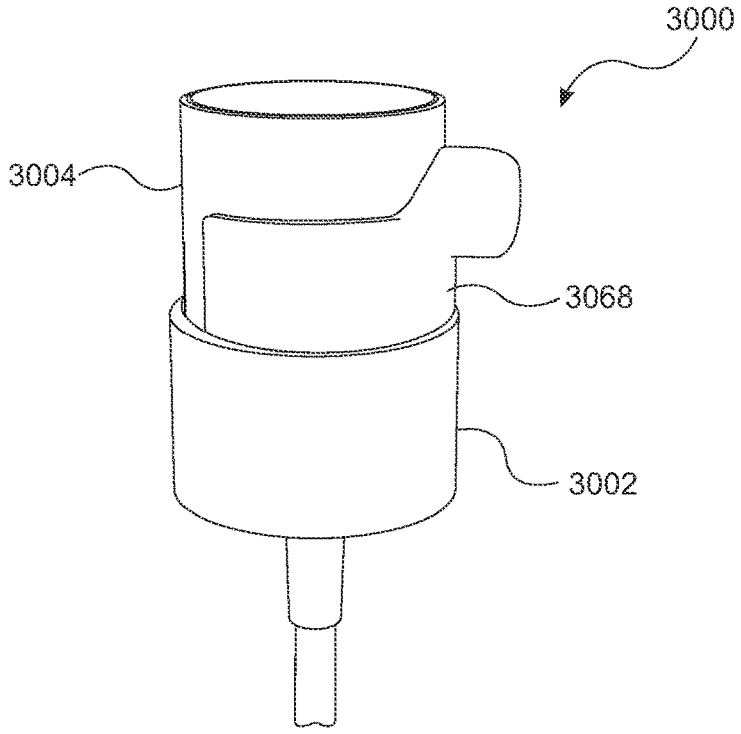
FIG. 29 illustrates a still further exemplary dispensing system with added features to reduce leakage during shipment.
Figure 30:
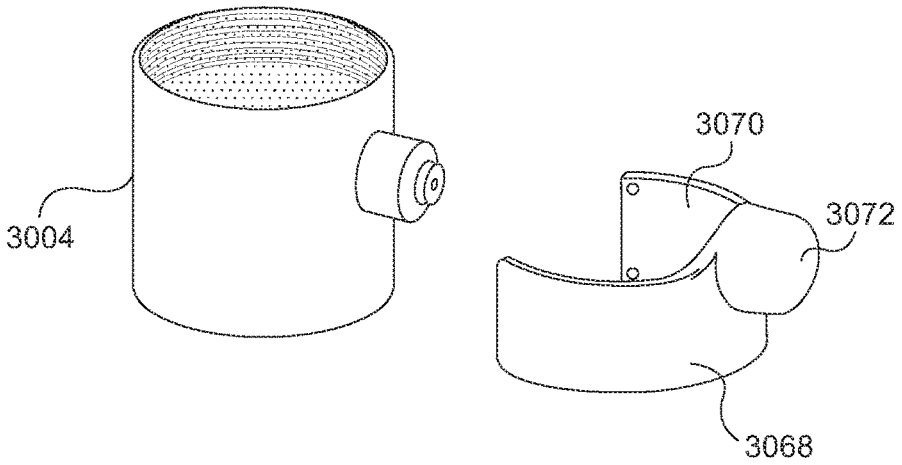
FIG. 30 illustrates an exploded view of the dispensing head and cover.
Figure 31:
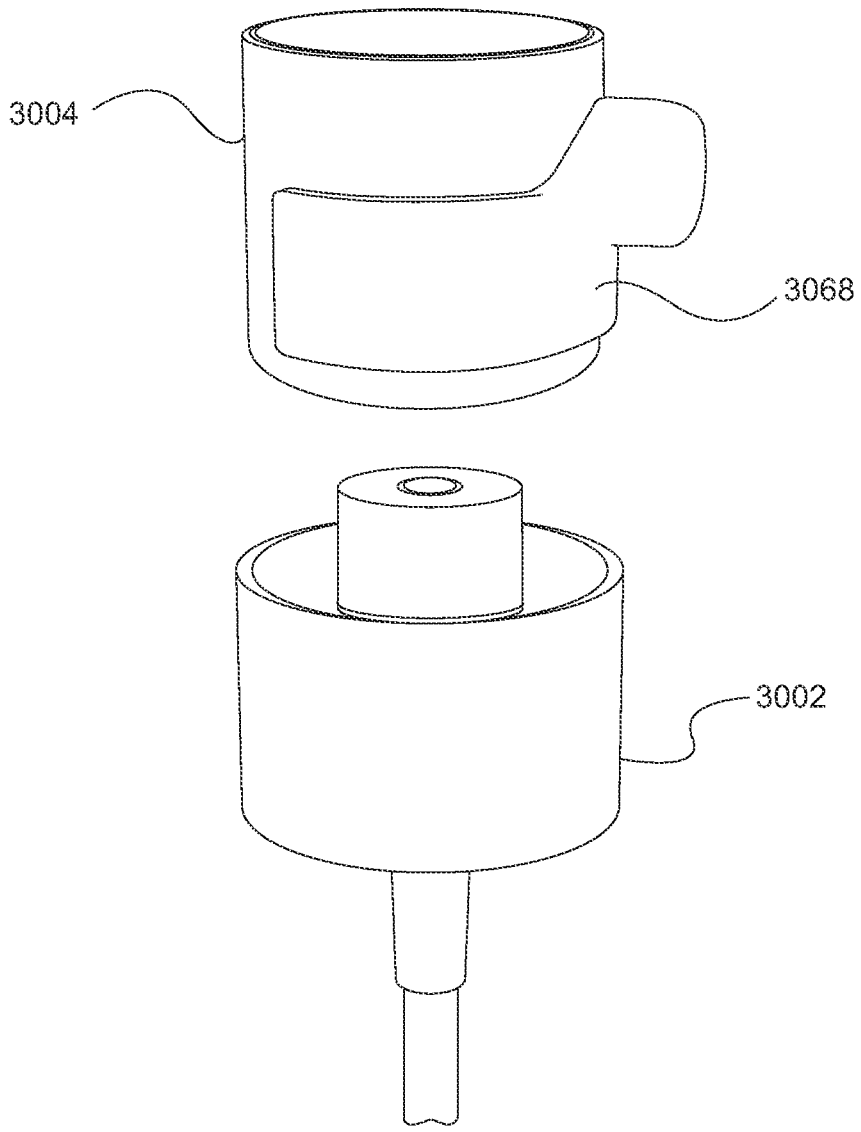
FIG. 31 illustrates an exploded view of the pump engine and co-acting dispensing head.

Referring to FIGS. 28A-28F an exemplary dispensing system such as described in embodiments 2000, 2000A and 2000B is illustrated in an exemplary use sequence. Container 900 holds a base formulation 910 while additive dispensing head 2004 is empty to receive an additive formula 2054 (FIG. 28A). The additive gradient formulation 2054 is filled into the dispensing head 2004, capped and then mounted onto the closure 2008 and pump engine 2002. (FIGS. 28B-28D). When depressed, pump engine 2002 draws the base formulation 910 from the container 900, forces it through the piston stem 2016, mixing it with the active ingredient formulation 2054 to provide a fully mixed formulation (FIG. 28E). After numerous dispensing cycles, the active ingredient chamber 2052 empties while the base product lower chamber 2060 fills, and eventually the piston wall 2050 will meet with the cap 2028A revealing the "empty" indicia 2066. The dispensing head 2004 may be removed and refilled, or replaced, with a different dispensing head (now shown) with a different active ingredient formulation. In the meantime, the base formulation 910 in the container 900 has not been altered or tainted with the additive formulation.

It is also noted that the dispensing heads in embodiments 2000, 2000A and 2000B can also be removed and interchanged before emptying to provide the same interchangeability as described above with other embodiments. The lower chamber filling 2060 with the base formulation 910 provides a buffer zone preventing the active ingredient 2054 from tainting the base product formulation 910 in the container 900 and allowing free interchange of different dispensing heads.

Referring to FIGS. 29-43, a dispensing system 3000 in accordance with another exemplary embodiment generally includes a primary pump engine assembly 3002 and a co-acting dispensing head 3004. The present embodiment 3000 is generally similar to embodiment 2000 with the addition of features (spider valves and an external cover) to prevent leakage during shipment, handling and storage.

The pump engine 3002 assembly comprises an accumulator cup 3006 which is secured within the neck of a container 900 (shown in FIG. 36) with a closure 3008 that engages with the neck of the container. In some embodiments, the closure 3008 may be threaded as illustrated. The accumulator 3006 has a clip tube inlet 3010 formed in the bottom wall thereof. A ball valve 3012, or other fluid valve structure is disposed within the clip tube inlet 3010 and a clip tube 3014 extends from the inlet 3010 to draw base product 910 from the container 900.

The dispensing head assembly 3004 is received onto a piston stem 3016 of the pump engine 3002 which extends through an axial opening in the closure body 3008. A spring 3018 is captured between the upper surface of the closure body 3008 and a bottom surface of a guide body 3020 to axially bias the dispensing head assembly 3004 upwardly.

The dispensing head assembly 3004 comprises a nozzle body 3022 with an upwardly open receptacle which coaxially receives a nozzle core 3024 and an inverted cup shaped piston 3026. A cap 3028 is removably received onto the nozzle body 3022 over the open receptacle. The nozzle body 3022 has an outer side wall 3030 and a bottom wall 3032 which is recessed up into the interior of the body. This creates an annular channel into which the nozzle core 3024 and piston 3026 are received.

Figure 35:
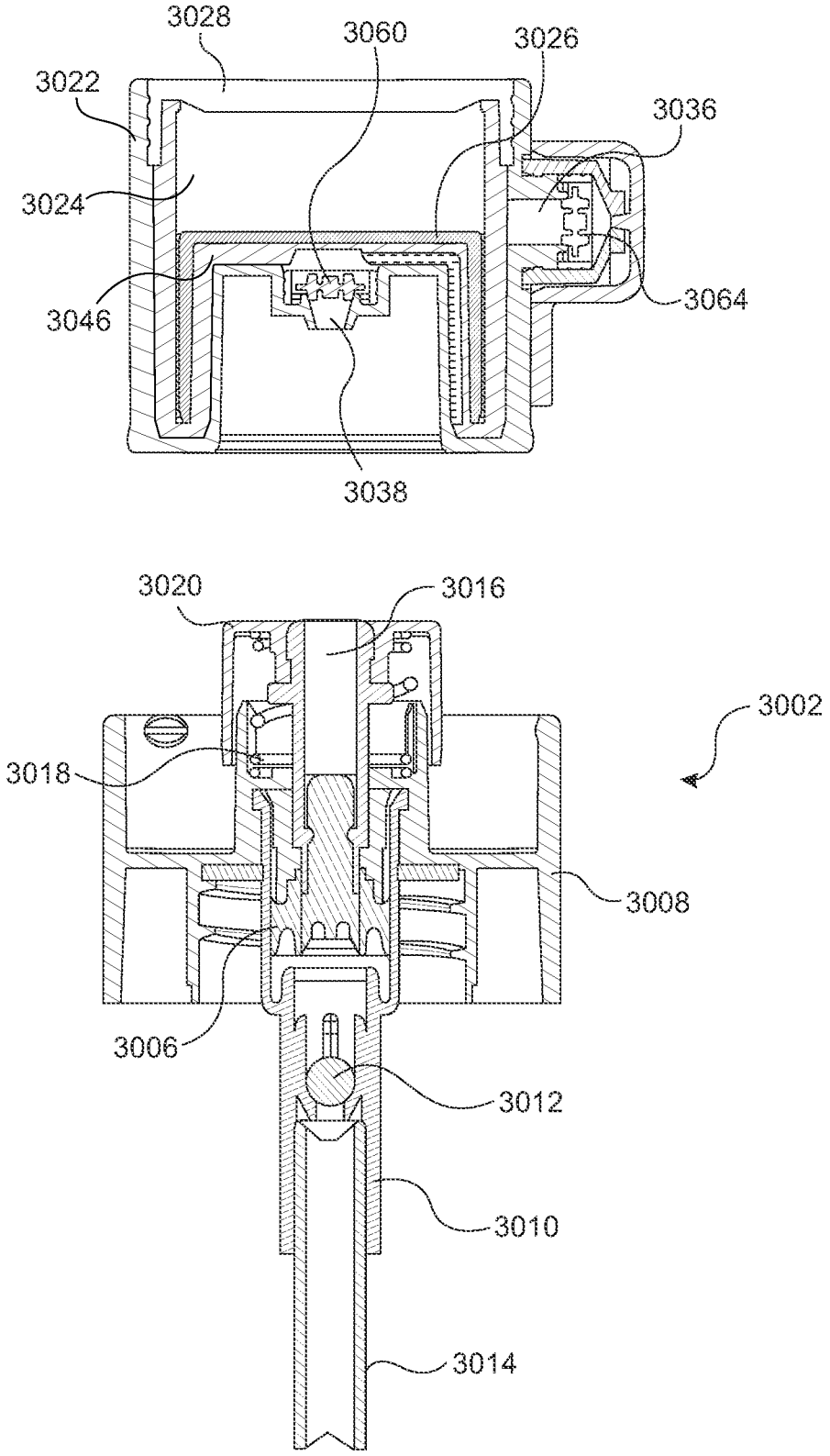
FIG. 35 illustrates another cross-sectional view thereof with the dispending head and pump engine separated.
Figure 36:
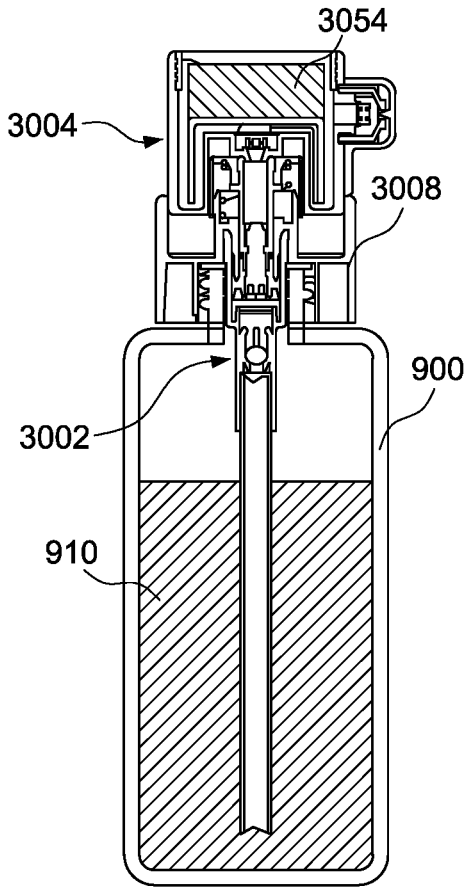
FIG. 36 illustrates a cross-sectional view of the dispensing system mounted on a container with a flowable base formulation.

The outer side wall 3030 of the nozzle body 3022 includes a dispensing orifice 3036 adjacent the upper peripheral edge thereof. The bottom wall 3032 of the nozzle body 3022 includes an inlet port 3038 extending through the bottom wall 2032 and downwardly. As best seen in FIG. 35, the inlet port 2038 is seated into the top of the piston stem 3026 of the pump engine 3002.

The nozzle core 3024 includes a side wall 3040 and a bottom wall 3042 which is also recessed upwardly into the interior of the core creating an annular piston seat within the nozzle core 3024. The nozzle core 3024 nests within the nozzle body 3022 where the bottom surface of the bottom wall 3042 includes spacing shoulders 3046 to create a narrow base product flow path beneath the upper surface of the bottom wall 3032 of the nozzle body 3022 and the lower surface of the bottom wall 3042 of the nozzle core 3024. The piston 3026 nests within the nozzle core 3024 with its sidewalls 3048 received in the annular piston seat, and its top wall 3050 resting on the bottom wall 3042 of the nozzle core 3024. This creates an active ingredient chamber 3052 above the top wall 3050 of the piston 3026. An active ingredient formulation 3054 (liquid, gel, lotion etc.) may be received into the chamber 3052. The active ingredient formulation 3054 may include a carrier material which facilitates a fluid flow. The cap 3028 is snap received into the upper lip of the nozzle body 3022. The cap walls and nozzle body lip may include interfitting snap formations to facilitate removal of the cap 3028, as well as filling and refilling of the additive ingredient formulation 3054.

A flow aperture 3056 is provided in the bottom wall 3042 of the core 3024, allowing base product 910 to flow into a lower base product chamber space 3059 (best seen in FIGS. 37B-37D) beneath the piston 3026. The outside surface of the nozzle core 3024 includes a recessed flow channel 3058 extending from the upper lip to the bottom edge. The upper portion of the channel 3058 provides a flow path for the active ingredient 3054 to flow from the inside of the nozzle core 3024, up and over the lip and into the channel 3058 to the aligned dispensing orifice 3036. The bottom portion of the channel 3058 provides a flow path for the base product 910 to flow from beneath the nozzle core 3024, up and around the bottom edge into the channel 3058 to the aligned dispensing orifice 3036. The active ingredient 3054 and the base product 910 meet in the channel 3058 adjacent to the dispensing orifice 3036 and are mixed as they exit through the dispensing orifice 3036. The nozzle core 3024 and nozzle body 3022 may be keyed (not shown) for alignment of the active ingredient flow passage/mixing channel/chamber 3058 with the dispensing orifice 3036.

As the pump engine 3002 is actuated, i.e. by pressing downwardly on the top of the dispensing head 3004, base product 910 flows from the piston stem 3016 beneath the nozzle core 3024 to the dispensing orifice 3036. A small amount of base product also flows through the flow aperture 3056 to the lower chamber space beneath the piston 3026. With each actuation, a lower base product chamber 3060 is created beneath the piston 3026, filling with base product 910 and pushing the piston 3026 upwardly to simultaneously push the active ingredient 3054 from the upper chamber 3052. This flow action will be described further hereinbelow with respect to FIGS. 37A-37D in which a progression of the dispensing sequence and gradual metering of the active ingredient formulation 3054 is illustrated.

Figure 37A:
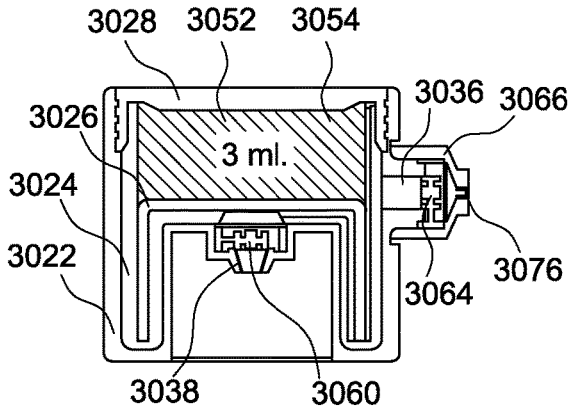
FIGS. 37A-37D illustrate an exemplary dispensing sequence showing movement of the internal spider valves.
Figure 37B:
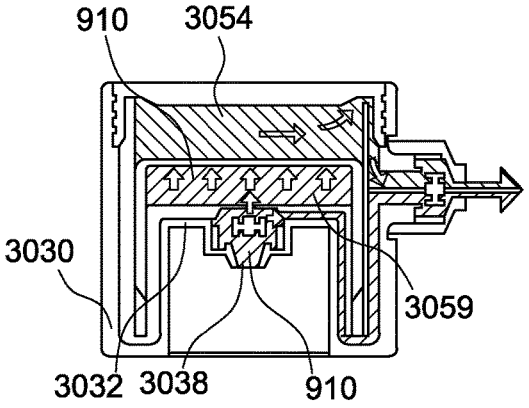
Figure 37C:
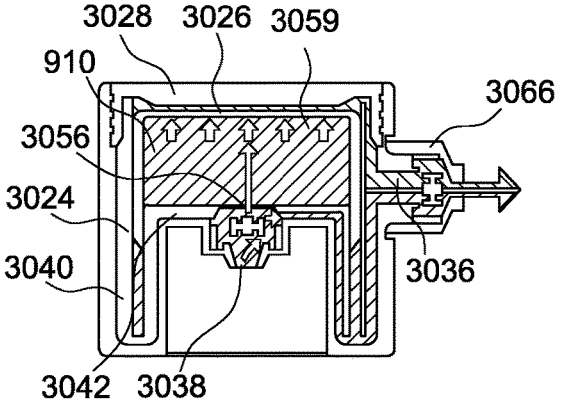

FIG. 37A illustrates the starting configuration of the dispensing system 3000 with the active ingredient chamber 3052 initially filled. The piston 3026 is fully seated within the nozzle core 3024, and there is no base product 910 beneath the piston 3026. As described above, as the pump engine 3002 is actuated (FIG. 37B), i.e. by pressing downwardly on the top of the dispensing head 3004, base product 910 flows from the piston stem 3016 beneath the nozzle core 3024 to the dispensing orifice 3036 (see main flow path arrows). A small amount of base product 910 also flows through the flow aperture 3056 (secondary flow path) to the space 3060 beneath the piston 3026 which simultaneously pushes the active ingredient 3054 from the upper chamber 3052 over the nozzle core side wall 3040 to the dispensing orifice 3036 (see flow path arrows 3064). Before reaching the exit orifice the formulation and additive flow paths meet each other resulting in one dose comprising both the base formulation and the additive.

Figure 37D:
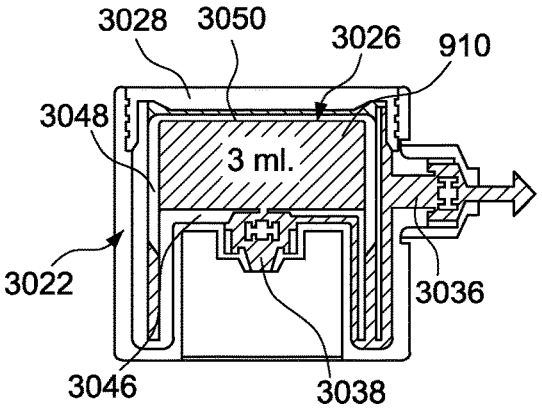
Figure 38:
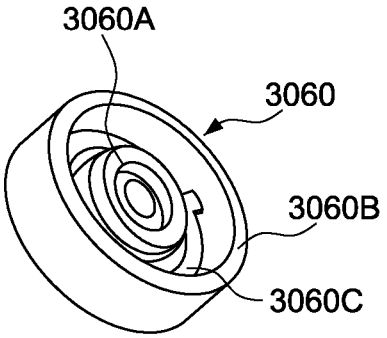
FIGS. 38 and 39 illustrate an exemplary spider valve as used within the exemplary embodiment.
Figure 39:
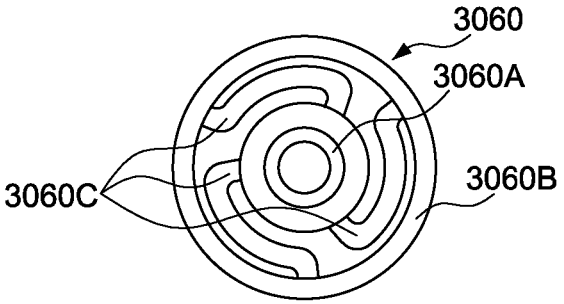
Figure 40:
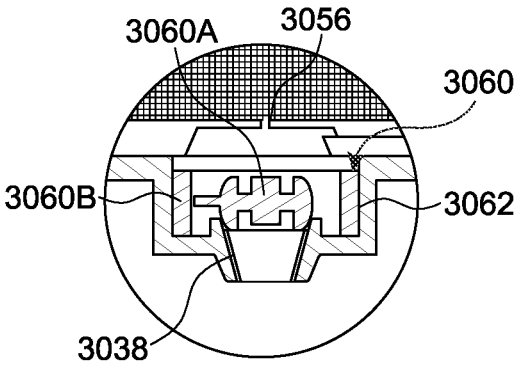
FIGS. 40 and 41 illustrate enlarged views showing movement of the inlet port spider valve between a closed position and an open position.
Figure 41:
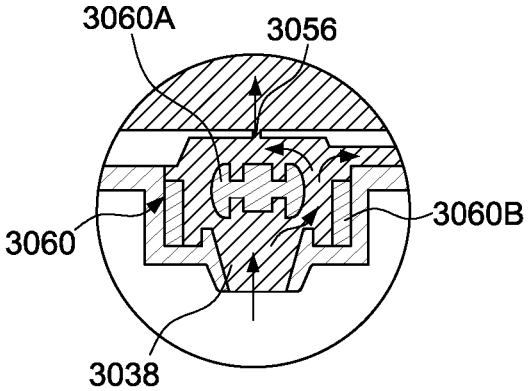
Figure 42:
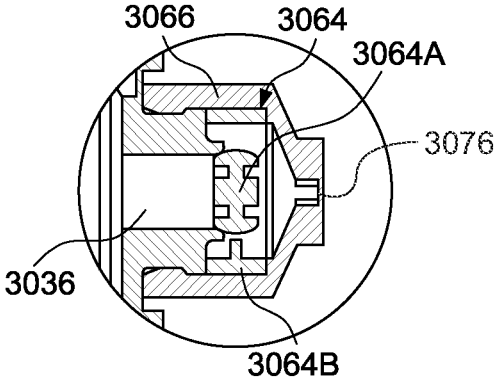
FIGS. 42 and 43 illustrate enlarged views showing movement of the exit orifice spider valve between a closed position and an open position.
Figure 43:
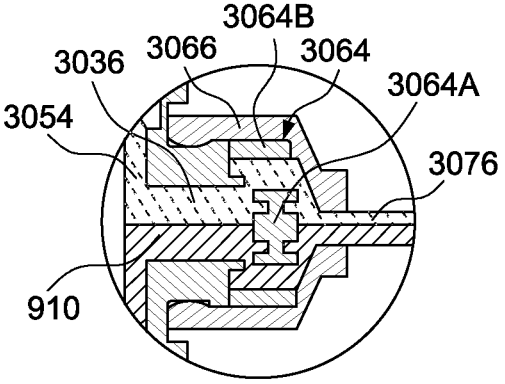

With each actuation, the lower base product chamber 3060 is increased in size beneath the piston 3026 (FIG. 37C), filling with base product 910 and pushing the piston 3026 upwardly. After numerous dispensing cycles, the active ingredient chamber 3052 empties while the base product lower chamber 3060 fills, and eventually the piston wall 3050 will meet with the cap 3028 (FIG. 37D). As previously seen in FIGS. 28A and 28F, and in FIG. 30, the cap 3028 can be made of a transparent or translucent material and graphical indicator markings can be placed on the piston wall 3050 to indicate to the user that the active ingredient chamber 3052 is "empty".

Figure 32:
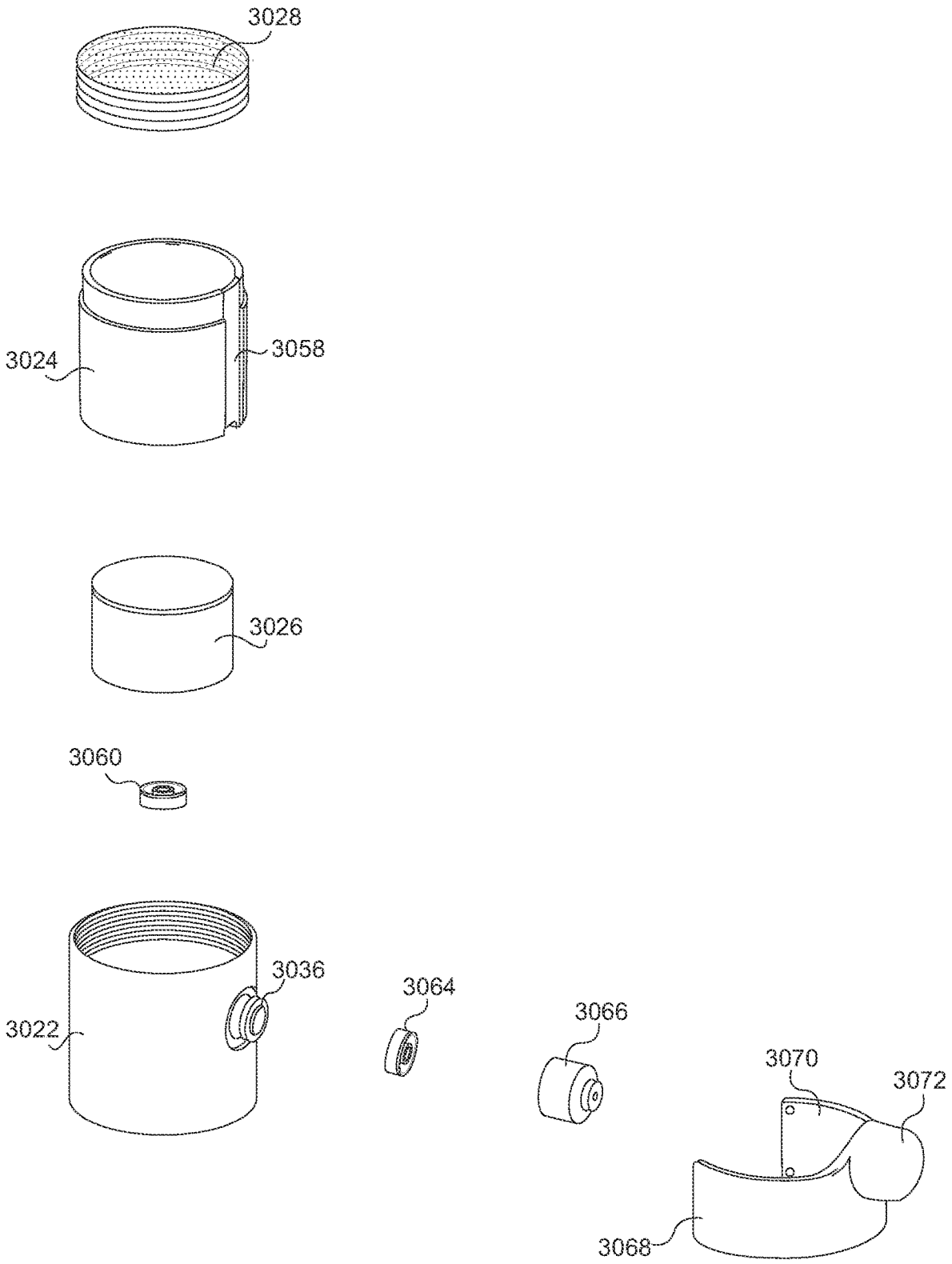
FIG. 32 illustrates and exploded view of the components of the dispensing head.
Figure 33:
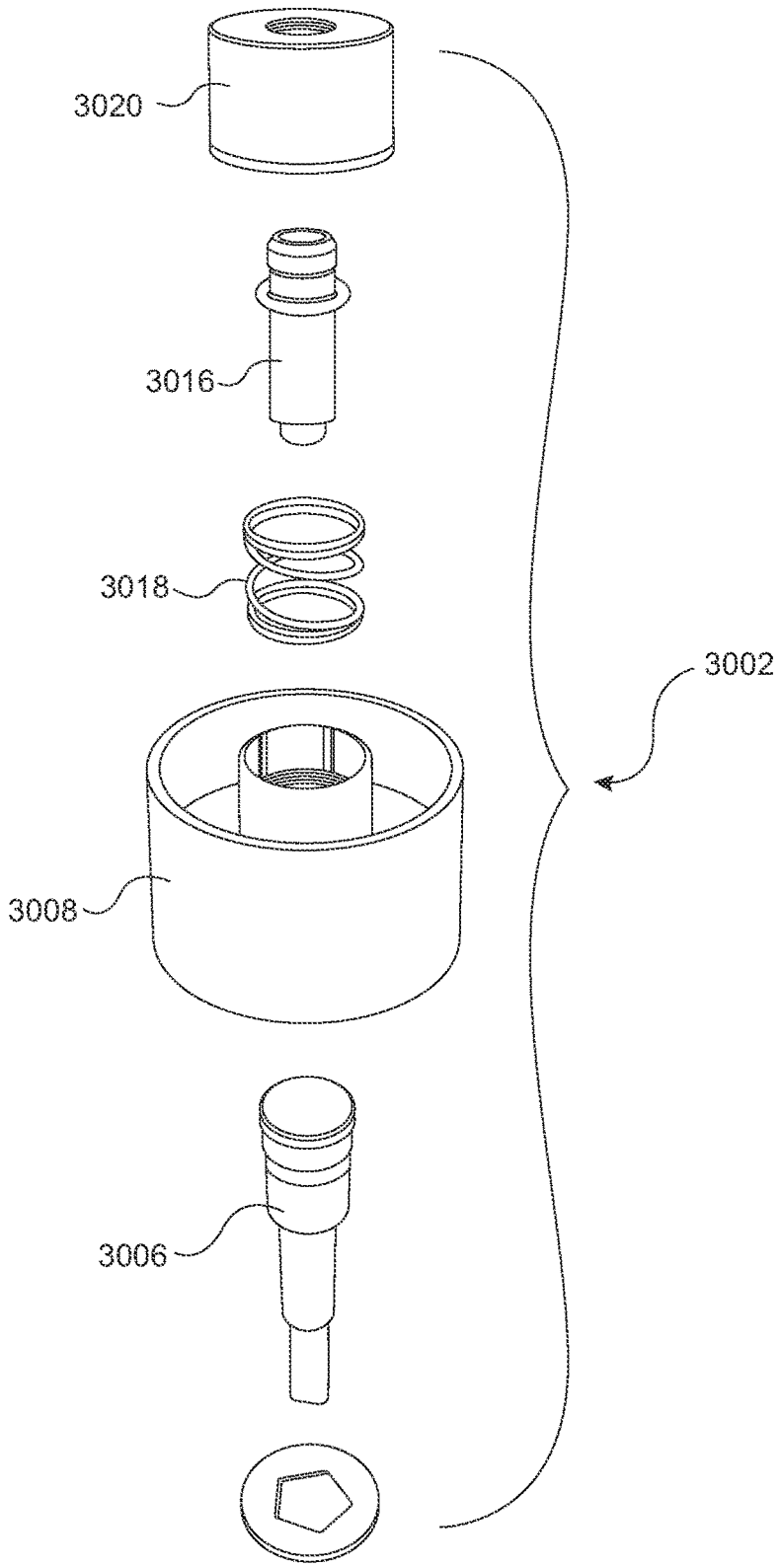
FIG. 33 illustrates an exploded view of the components of the pump engine.

Referring now to FIGS. 38-43, the present embodiment 3000 is provided with a first spider valve 3060 which may be press fit within a seat 3062 surrounding the inlet orifice 3038 and a second spider valve 3064 which also may be press fit within an external nozzle 3066 at the outlet orifice 3036 (See also FIG. 32). In order to protect the formulation 910 and active ingredient 3054 from drying out due to environmental exposure, the inlet and outlet orifices 3036 and 3038 are sealed with the noted spider valves 3060 and 3064. Spider valves 3060 and 3064 may be identical and the description below relative to valve 3060 applies to both valves 3060 and 3064. The exemplary spider valves 3060 and 3064 are molded plastic structures with a central sealing disc 3060A/3064A and an outer retainer ring 3060B/3064B. The sealing discs 3060A/3064A are elastically connected to the retainer rings 3060A/3064B by integrally molded spring arms 3060C/3064C which flex to allow displacement of the sealing discs 3060A/3064A relative to the outer retainer rings 3060A/3064B. At rest, the spider valves 3060 and 3064 are normally closed (See FIGS. 40 and 42) with the sealing discs 3060A/3064A seated in the inlet orifice 3038 and the exit orifice 3036. When the pump 3002 and dispensing head 3004 are actuated, the internal pump pressure pushes the spider valves 3060/3064 open and the formulation 910 fills the passages in the head 3004 forcing a dose of mixed formulation and additive through the exit orifice 3036 and nozzle 3066 (See FIGS. 41 and 43). When the head 3004 is released, the pressure is also released and the spider valves 3060/3064 return to their normal, at rest, closed condition.

Figure 34:
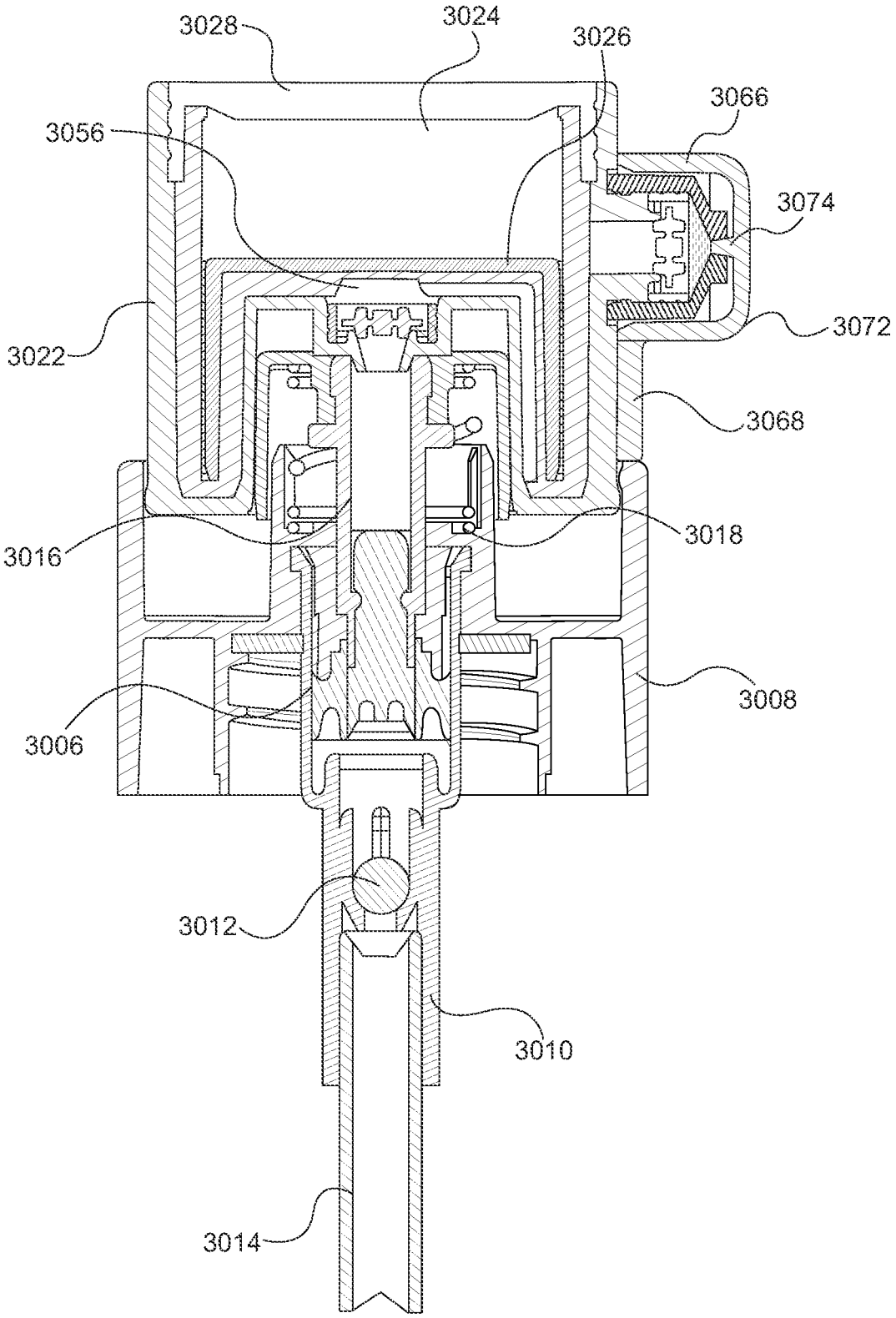
FIGS. 34 and 34A illustrate cross-sectional views of the dispensing system taken along line 34-34 of FIG. 29.
Figure 34A:
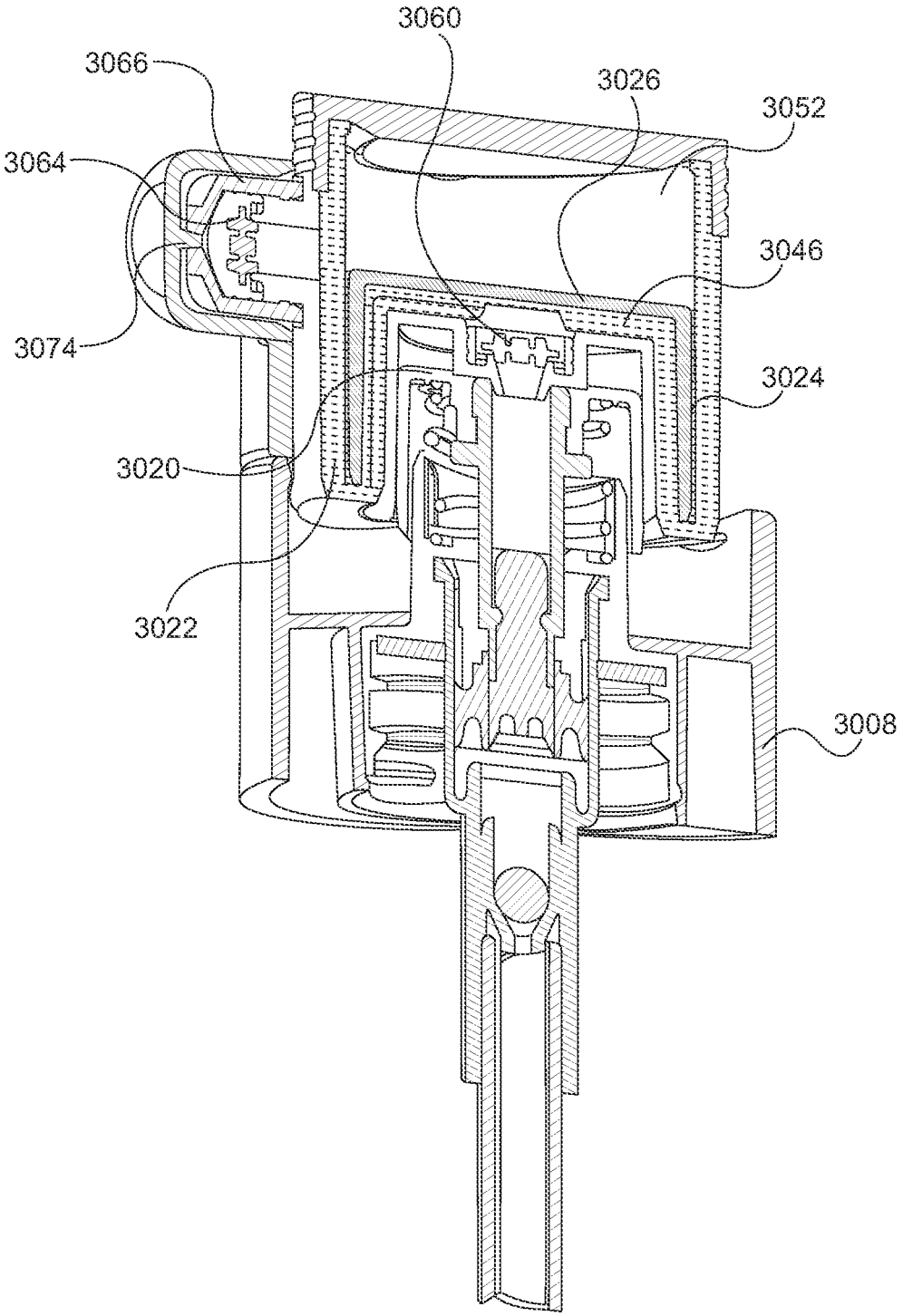

As a further measure of protection, the present embodiment 3000 is provided with an external flexible cover 3068 having an arcuate wall portion 3070 extending slightly more than 180 degrees around the nozzle body 3022, a cup portion 3072 sized to be received over the nozzle 3066, and a sealing pin 3074 configured to be received into an exit opening 3076 in the nozzle 3066 (See FIGS. 34 and 35). The cover 3068 may be selectively removed and replaced as needed and is held in position by the interfitting relationship of the cup portion 3072 and the nozzle 3066 as well and the flexible wall portion 3070 which extends slightly more than 180 degrees around the nozzle body 3022. The external cover 3068 works as a "barrier" between the nozzle 3066 and the environment. In this way, nearby objects are not inadvertently exposed to the dispensed formulation and likewise the formulation is not contaminated by the external environment. The cover 3068 also prevents leakage in the case of depressurization during high altitude plane flights. When the dispensers 3000 are transported in a cargo plane hold, the difference in pressure may cause air bubbles inside the formulation 910 to expand, increasing the total volume in the head 3004 and pushing formulation out through the nozzle 3066. The sealing pin 3074 in the cover 3068 functions as another seal to prevent leakage.

It can therefore be seen that the present disclosure provides for a novel dispensing system wherein multiple additive mixing devices or heads can be selectively installed onto a container with a pump engine to mix the additive with a base formulation in the container. The base formulation is drawn from the container and forced through the additive mixing head to create a custom product with each pump actuation.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A dispensing system comprising:

a container;

a flowable base formulation contained within the container;

a pump engine mounted on the container and in fluid communication with said base formulation;

a dispensing head having a dispensing orifice, a piston;

an additive ingredient chamber defined above said piston, a base product chamber, configured and arranged to be filled with said base formulation, defined below said piston and having an inlet port in fluid communication with said pump engine, a flow path from said additive ingredient chamber to said dispensing orifice, a flow path from said base product chamber to said dispensing orifice; and an additive ingredient contained within the additive ingredient chamber, wherein the pump engine draws the flowable base formulation from the container and pumps it through the dispensing head, and wherein said additive ingredient is introduced into, and mixed with the base formulation traveling through the dispensing orifice with each actuation, and wherein the pump engine and the dispensing head are coaxially spring biased.

2. The dispensing system of claim 1 wherein the dispensing head includes a removable cap over an opening into the additive ingredient chamber, wherein the additive ingredient chamber is refillable.

3. The dispensing system of claim 2, wherein the dispensing head is removably mounted onto the pump engine.

4. The dispensing system of claim 1, wherein the dispensing head is removably mounted onto the pump engine.

5. The dispensing system of claim 4, wherein said inlet port includes a valve.

6. The dispensing system of claim 5, wherein said dispensing orifice includes a valve.

7. The dispensing system of claim 4, wherein said dispensing orifice includes a valve.

8. The dispensing system of claim 1, wherein said inlet port includes a valve.

9. The dispensing system of claim 8, wherein said dispensing orifice includes a valve.

10. The dispensing system of claim 9, further comprising a removable cover having a sealing pin, said removable cover being selectively disposed on said dispensing head with said sealing pin engaged within said dispensing orifice.

11. The dispensing system of claim 8, further comprising a removable cover having a sealing pin, said removable cover being selectively disposed on said dispensing head with said sealing pin engaged within said dispensing orifice.

12. The dispensing system of claim 1, wherein said dispensing orifice includes a valve.

13. The dispensing system of claim 12, further comprising a removable cover having a sealing pin, said removable cover being selectively disposed on said dispensing head with said sealing pin engaged within said dispensing orifice.

14. A dispensing system comprising:

a container;

a flowable base formulation contained within the container;

a pump engine mounted on the container and in fluid communication with said base formulation;

a dispensing head having a dispensing orifice, a piston;

an additive ingredient chamber defined above said piston, a base product chamber, configured and arranged to be filled with said base formulation, defined below said piston and having an inlet port in fluid communication with said pump engine, a flow path from said additive ingredient chamber to said dispensing orifice, a flow path from said base product chamber to said dispensing orifice;

an additive ingredient contained within the additive ingredient chamber; and a removable cover having a sealing pin, said removable cover being selectively disposed on said dispensing head with said sealing pin engaged within said dispensing orifice, wherein the pump engine draws the flowable base formulation from the container and pumps it through the dispensing head, and wherein said additive ingredient is introduced into, and mixed with the base formulation traveling through the dispensing orifice with each actuation.

* * * * *